US007318497B2

(12) United States Patent
Okunosono

(10) Patent No.: US 7,318,497 B2
(45) Date of Patent: Jan. 15, 2008

(54) EXHAUST DEVICE INCLUDING A RESIN MUFFLER COVER AND MUFFLER PROTECTOR

(75) Inventor: Toshihiko Okunosono, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 217 days.

(21) Appl. No.: 10/933,448

(22) Filed: Sep. 3, 2004

(65) Prior Publication Data

US 2005/0082113 A1 Apr. 21, 2005

(30) Foreign Application Priority Data

Sep. 9, 2003 (JP) ..... 2003-317444

(51) Int. Cl.
*F01N 7/08* (2006.01)

(52) U.S. Cl. ..... 181/227; 181/228; 180/309; 180/89.2; 180/68.3; 180/296

(58) Field of Classification Search ..... 181/27, 181/227, 228; 180/309, 89.2, 296, 68.3
See application file for complete search history.

(56) References Cited

U.S. PATENT DOCUMENTS 4,354,573 A * 10/1982 Tabata et al. ..... 181/239
4,356,885 A * 11/1982 Dello ..... 181/227
4,475,622 A * 10/1984 Tsunoda et al. ..... 181/227
4,637,486 A * 1/1987 Iwai ..... 180/225
5,934,240 A * 8/1999 Yokocho et al. ..... 123/195 C
6,085,863 A * 7/2000 Shuen ..... 181/228
6,797,402 B2 * 9/2004 Chen et al. ..... 428/595
6,802,383 B2 * 10/2004 Nishijima ..... 180/190
7,007,720 B1 * 3/2006 Chase et al. ..... 138/110
2001/0030072 A1 * 10/2001 Okuma ..... 180/219
2002/0079162 A1 * 6/2002 Huff et al. ..... 181/282
2003/0079938 A1 * 5/2003 Yamaguchi ..... 181/227
2004/0178012 A1 * 9/2004 Takano ..... 180/227

FOREIGN PATENT DOCUMENTS

EP 0448728 A 10/1991
JP 03-096616 A 4/1991
JP 4-35989 A 2/1992
JP 2001-303925 A 10/2001

* cited by examiner

*Primary Examiner*—Lincoln Donovan
*Assistant Examiner*—Forrest Phillips
(74) *Attorney, Agent, or Firm*—Birch, Stewart, Kolasch & Birch, LLP

(57) ABSTRACT

To provide an exhaust device for enhancing the appearance quality, secure the degree of freedom in designing and enhance the cooling performance. An exhaust device in which a second exhaust muffler at a rear portion of an exhaust system extends rearwardly from an engine is disposed in a rear portion of a rear cowl wherein a rear end surface of the second exhaust muffler is covered with a resin-made muffler rear cover.

28 Claims, 24 Drawing Sheets

EXHAUST DEVICE INCLUDING A RESIN MUFFLER COVER AND MUFFLER PROTECTOR

CROSS-REFERENCE TO RELATED APPLICATIONS

The present application claims priority under 35 USC 119 to Japanese Patent Application No. 2003-317444 filed on Sep. 9, 2003 the entire contents of which are hereby incorporated by reference.

BACKGROUND OF THE INVENTION

1. Field of the Invention

The present invention relates to an exhaust device for a vehicle, for example, a motorcycle.

2. Description of Background Art

Conventionally, exhaust devices are known wherein a muffler positioned at a rear portion of an exhaust system extends rearwardly from an engine and is disposed in a rear cowl. In such exhaust devices the rear cowl may be provided with a bulged portion in the left-right direction. The bulged portion is provided with an air guide portion, while the rear cowl is provided with an air exhaust port at a rear portion thereof. In addition, the muffler is disposed along a cooling passage extending from the air guide port to the air exhaust port. See, for example, Japanese Patent Laid-Open No. Hei 4-35989.

The above-mentioned exhaust device makes it possible to efficiently guide a running airflow and thereby to cool the muffler. However, this exhaust device involves a problem in that the bulged portion must be formed in a large size. Therefore, the designing of the vehicle body is greatly restricted.

In view of this problem, in order to suppress the bulging amount in the width direction without varying the volume of the muffler which affects the noise insulation performance, it may be contemplated to extend a rear portion of the muffler to the rear side so as to suppress the bulging of the vehicle body in the vehicle width direction and enhance the degree of freedom in designing, without spoiling the exhaust noise reducing function. If such an approach is adopted, however, the rear portion of the muffler would project out, thereby spoiling the appearance quality.

SUMMARY AND OBJECTS OF THE INVENTION

Accordingly, it is an object of the present invention to provide an exhaust device which makes it possible to enhance the appearance quality, to secure the degree of freedom in designing and to enhance cooling performance.

In order to solve the above-mentioned problems, the present invention resides in an exhaust device including a second exhaust muffler 155 at a rear portion of an exhaust system 150 extending rearwardly from an engine E. The muffler is disposed in a rear portion of a rear cowl 184 wherein a rear end surface of the muffler is covered with a resin-made muffler rear cover 187.

With this configuration, the continuity on an appearance basis between the muffler projecting toward the rear side of the rear cowl and the vehicle body can be maintained while permitting the noise reducing effect of the exhaust system to be displayed sufficiently.

The present invention resides in an exhaust device including a muffler at a rear portion of an exhaust system extending rearwardly from an engine with the muffler being disposed in a rear portion of a rear cowl. The rear cowl is provided with a muffler protector 197 and a muffler rear cover for covering a rear portion of the muffler that is mounted to the muffler protector.

With this configuration, it is possible to insulate the heat coming from the muffler by the muffler protector and prevent the heat of the muffler from being transmitted directly to the muffler rear cover.

The present invention resides in an exhaust device including a muffler at a rear portion of an exhaust system extending rearwardly from an engine with the muffler being disposed in a rear portion of a rear cowl. A metallic muffler protector is provided for covering a lower surface 201*u* of a rear fender upper 201 at a position spaced from the rear fender by a predetermined interval. A muffler rear cover is provided for covering an upper surface 155*u* and both side surfaces 155*s* of the muffler that is mounted to the muffler protector.

With this configuration, it is possible to insulate the heat coming from the muffler by the muffler protector and to prevent the heat of the muffler from being transmitted directly to the muffler rear cover. In addition, the heat coming from the muffler is cooled by air flowing between the muffler and the muffler protector and along the lower surface of the rear portion of the muffler which is opened.

The present invention provides a plurality of rear portion opening portions 189 of the muffler that are arranged in the vehicle width direction.

With this configuration, it is possible to secure an exhaust gas flow route in the vehicle width direction, to reduce the front-rear length of the muffler, to secure the areas of upper and lower surfaces of the muffler to be large and to achieve effective cooling on the upper and lower surfaces.

According to the present invention, it is possible to maintain the continuity on an appearance basis between the muffler projecting rearwardly from the rear cowl and the vehicle body while permitting the noise reducing effect of the exhaust system to be displayed sufficiently. Therefore, it is possible to enhance the appearance quality and to secure the degree of freedom in designing.

According to the present invention, it is possible to insulate the heat coming from the muffler by the muffler protector and to prevent the heat of the muffler from being transmitted directly to the muffler rear cover. Therefore, it is unnecessary to use a muffler rear cover formed of a heat-resistant special material or to adopt a complicated mode of mounting with a measure against heat. In addition, it is possible to contrive a reduction in cost.

According to the present invention, it is possible to insulate the heat coming from the muffler by the muffler protector and to prevent the heat of the muffler from being transmitted directly to the muffler rear cover. In addition, the heat coming from the muffler is cooled by air flowing between the muffler and the muffler protector and along the lower surface of the rear portion of the muffler which is opened. Thus, the cooling performance for the muffler can be enhanced.

According to the present invention, it is possible to secure an exhaust gas flow route in the vehicle width direction, to reduce the front-rear length of the muffler, to secure the areas of upper and lower surfaces of the muffler to be large and to achieve effective cooling through the upper and lower surfaces. Therefore, it is possible to enhance the appearance quality through restraining the rearward projection of the muffler as much as possible.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
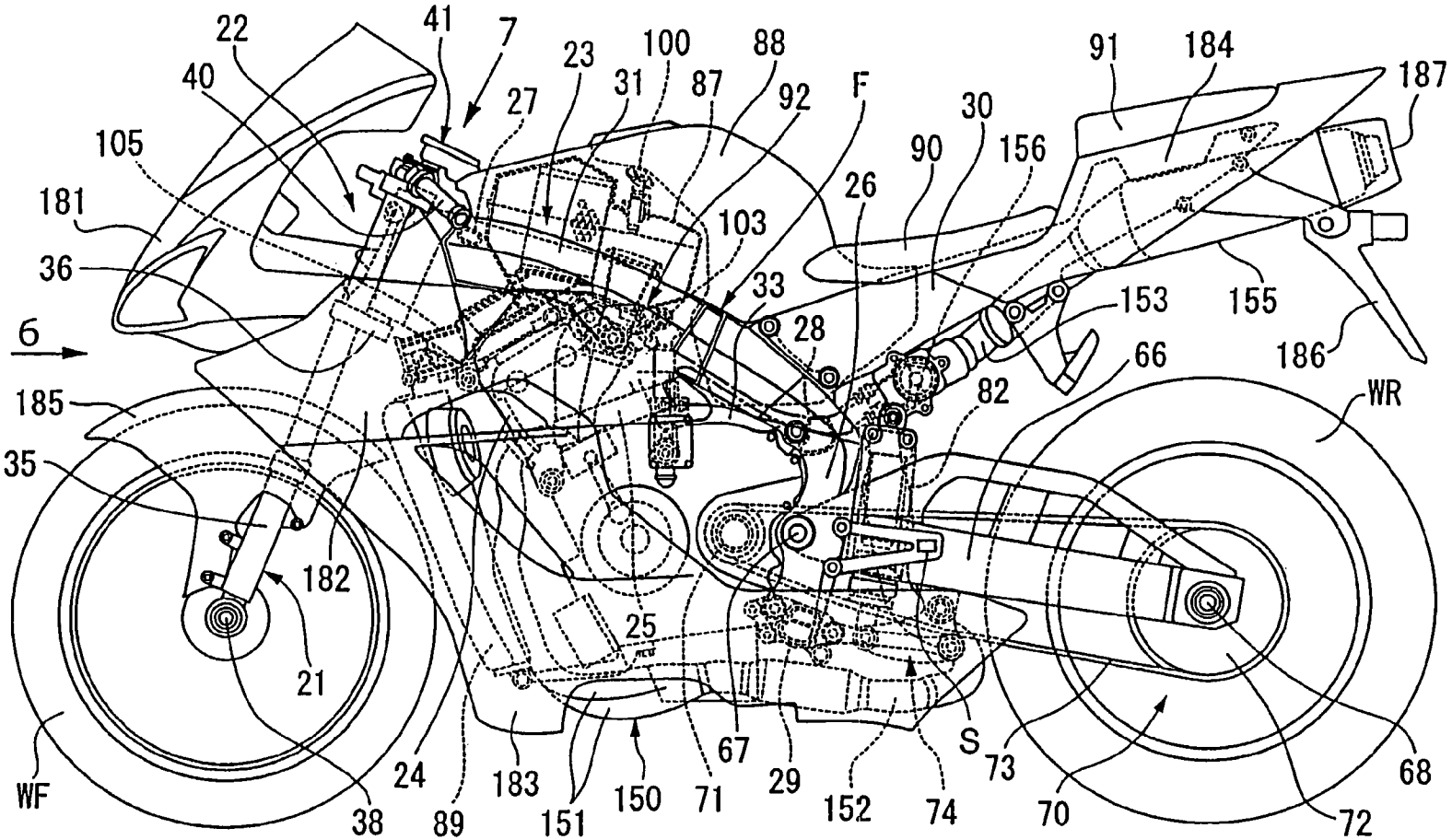
FIG. 1 is a side view of a motorcycle according to one embodiment of the present invention.

Now, a first embodiment of the present invention will be described referring to the drawings.

Figure 2:
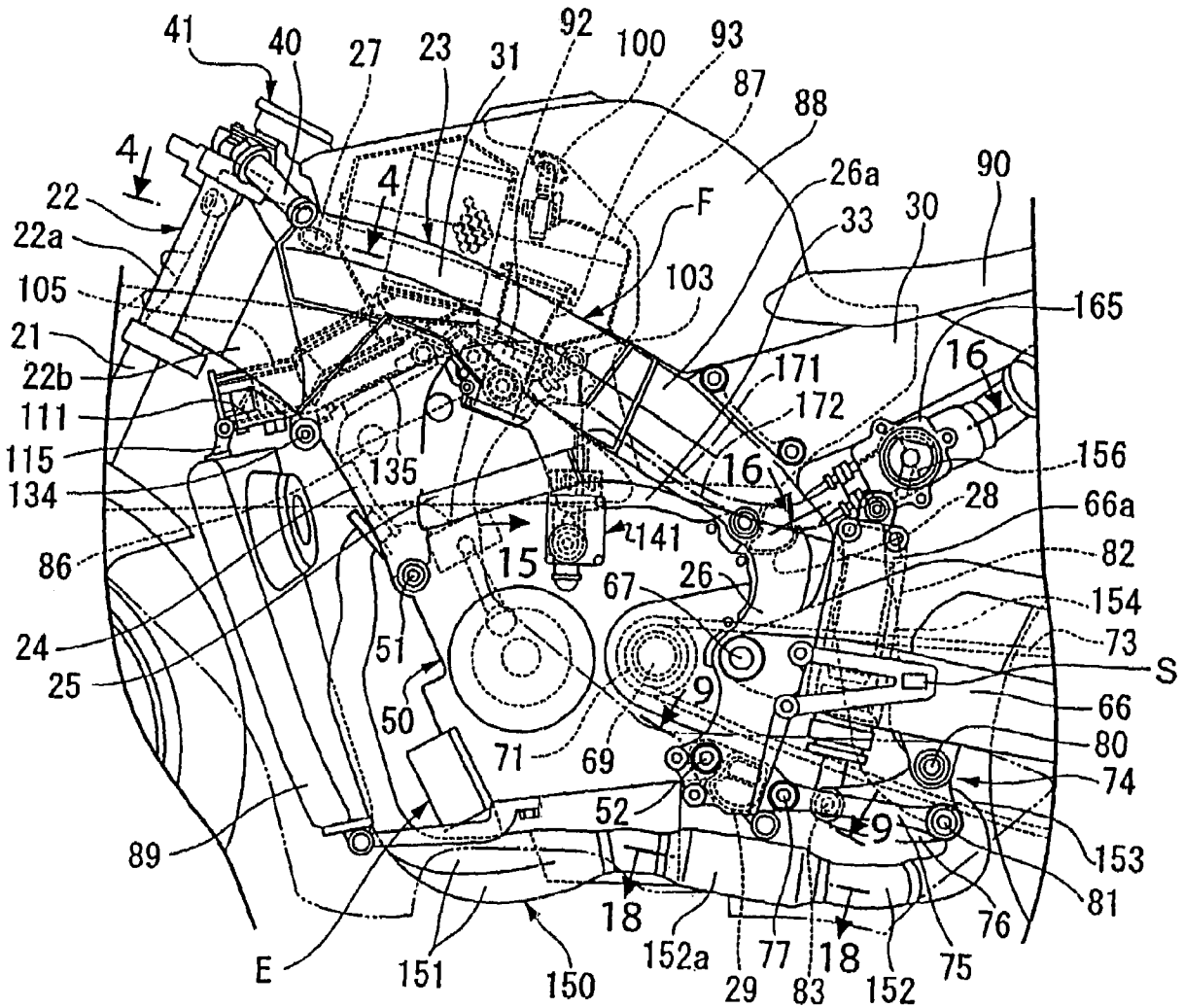
FIG. 2 is an enlarged view of an essential part of FIG. 1.
Figure 3:
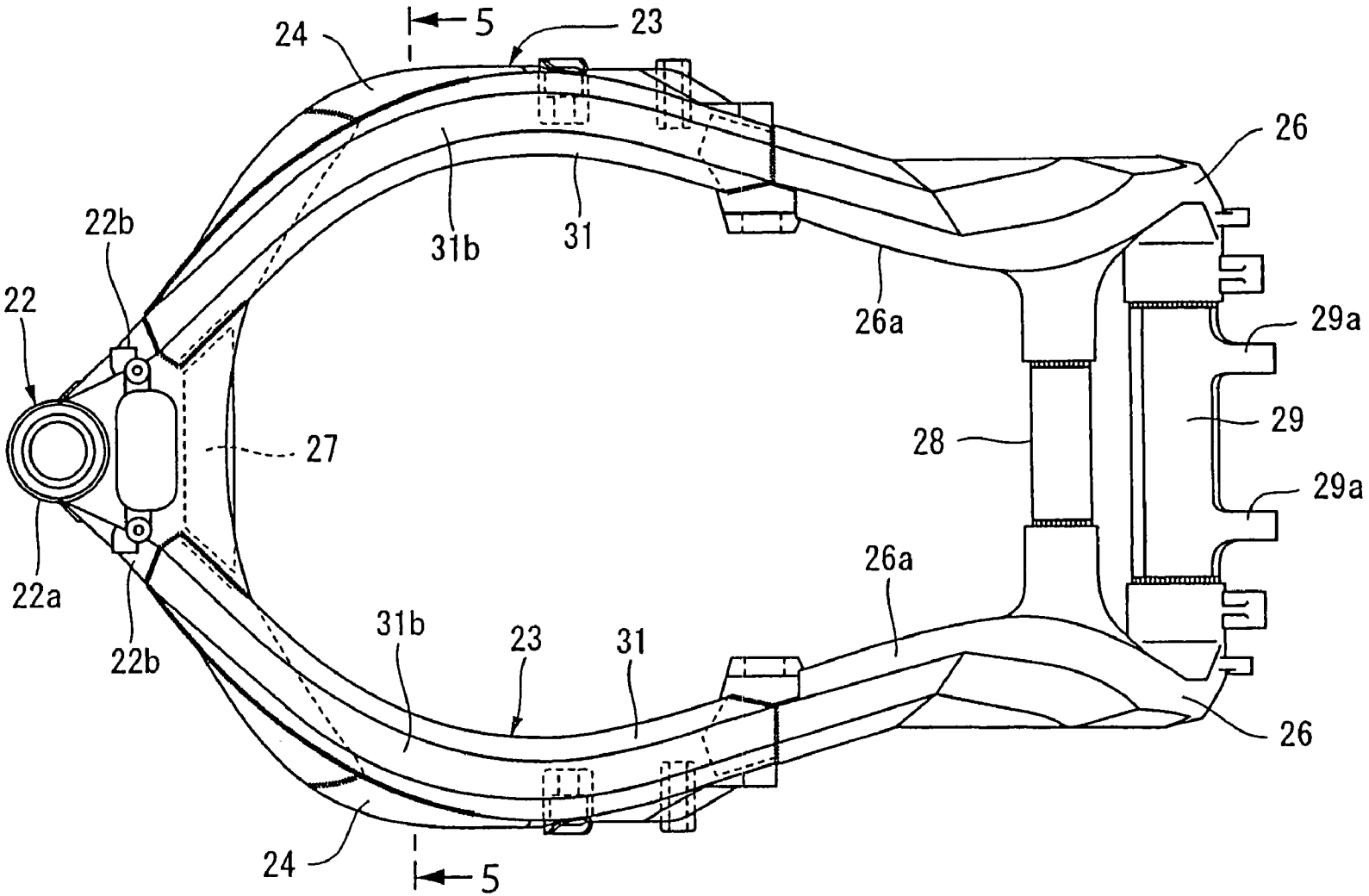
FIG. 3 is a plan view of a front portion of a vehicle body frame.

In FIGS. 1 to 3, a vehicle body frame F of the motorcycle includes a head pipe 22 for steerably supporting a front fork 21 for a shaft supporting a front wheel WF. A left-right pair of main frames 23 . . . extend rearwardly and downwardly from the head pipe 22 with a left-right pair of engine hangers 24 . . . welded to the head pipe 22 and front portions of both the main frames 23 . . . and extending downwardly from the main frames 23 . . . . Connection pipes 25 . . . are provided for connecting between support plate portions 33 . . . which are provided at lower portions of both the engine hangers 24 . . . and rear portions of the main frames 23 . . . . A left-right pair of pivot plates 26 . . . extend downwardly from rear portions of the main frames 23 . . . with a first cross pipe 27 bridgingly disposed between front portions of the main frames 23 . . . . A second cross pipe 28 is bridgingly disposed between upper portions of both the pivot plates 26 . . . with a third cross pipe 29 bridgingly disposed between lower portions of both the pivot plates 26 . . . . A seat rail 30 of a left-right integral structure extends rearwardly and upwardly and connects to rear portions of both the main frames 23 . . . . Incidentally, steps S are attached to both the pivot plates 26 through holders.

Figure 4:
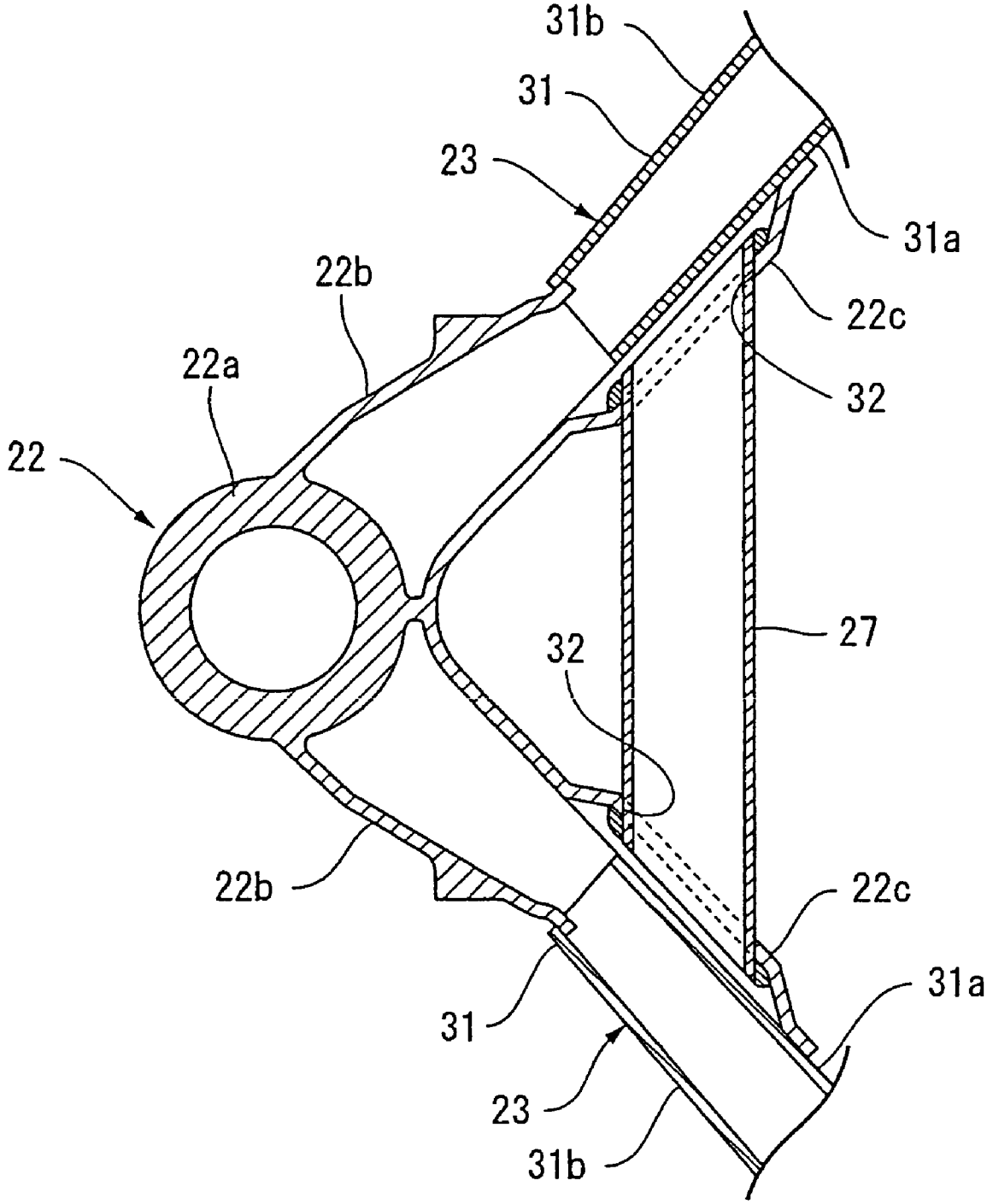
FIG. 4 is an enlarged sectional view of the front portion of the vehicle body frame as taken along line 4-4 of FIG. 2.

In FIG. 4, the head pipe 22 integrally includes a hollow cylindrical portion 22 for steerably supporting the front fork 21 with a left-right pair of gussets 22*b*, 22*b* extending rearwardly and downwardly from the hollow cylindrical portion 22*a*. The main frame 23 includes the gusset 22*b*, a pipe member 31 welded at its front end portion to the gusset 22*b* and a pipe portion 26*a* provided as one body with the pivot plate 26 and welded to a rear end portion of the pipe member 31.

For bridgingly disposing the first cross pipe 27 between the front portions of the main frames 23, 23, inside walls of the main frames 23, 23 are coaxially provided with mount holes 32, 32. Both end portions of the first cross pipe 27 passing through the mount holes 32, 32 are welded to the inside walls of both of the main frames 23, 23.

Both of the gussets 22*b*, 22*b* of the head pipe 22 are integrally provided with extending portions 22*c*, 22*c* extending rearwardly while being disposed on the inner side of front inside walls of the pipe members 31, 31 so as to constitute front inside walls of the main frames 23, 23. The extending portions 22*c*, 22*c* are provided respectively with the mount holes 32, 32 for passing both end portions of the first cross pipe 27 therethrough so that both ends are opposed to the front inside walls of the pipe members 31, 31. Both end portions of the first cross pipe 27 are welded to the outside surfaces of both of the extended portions 22*c*, 22*c*.

Figure 5:
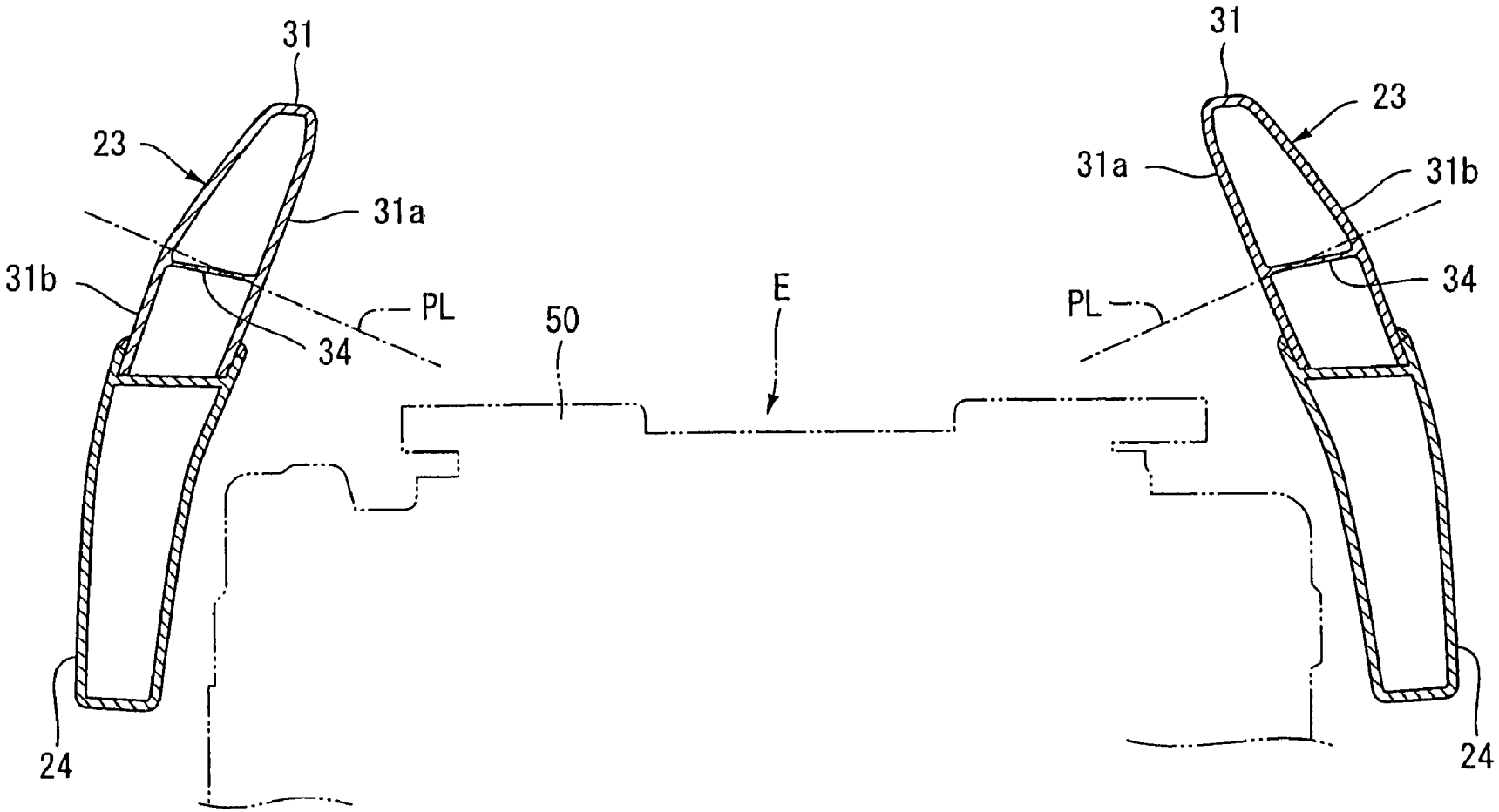
FIG. 5 is a sectional view as taken along line 5-5 of FIG. 3.

Referring to FIG. 5 also, the pipe member 31 is, for example, formed to have a polygonal tubular cross-sectional outer shape from an ingot of an aluminum alloy by a conventionally known extrusion or drawing method. A rib 34 for partitioning the inside of the pipe member 31 into upper and lower portions is integrally provided between inside surfaces of intermediate portions in the vertical direction of the pipe member 31. It should be noted here that a lower portion of the pipe member 31, at the portion to which the engine hanger 24 is welded, is cut out to be opened downwardly, i.e., towards the side of the engine hanger 24.

Meanwhile, the pipe member 31 is formed in a vertically elongate polygonal tubular shape while having an inside wall 31 a flat over substantially the entire vertical length thereof and an outside wall 31*b* extending substantially along the inside wall 31*a* and being bent in a plane PL orthogonal to the inside wall 31*a* so that an intermediate portion in the longitudinal direction thereof is curved convex to the outer side. In addition, both the pipe members 31, 31 after the bending work are joined to the gussets 22*b*, 22*b* of the head pipe 22 in a state of being inclined so that the pipe members 31, 31 approach each other as one goes upwardly.

Figure 6:
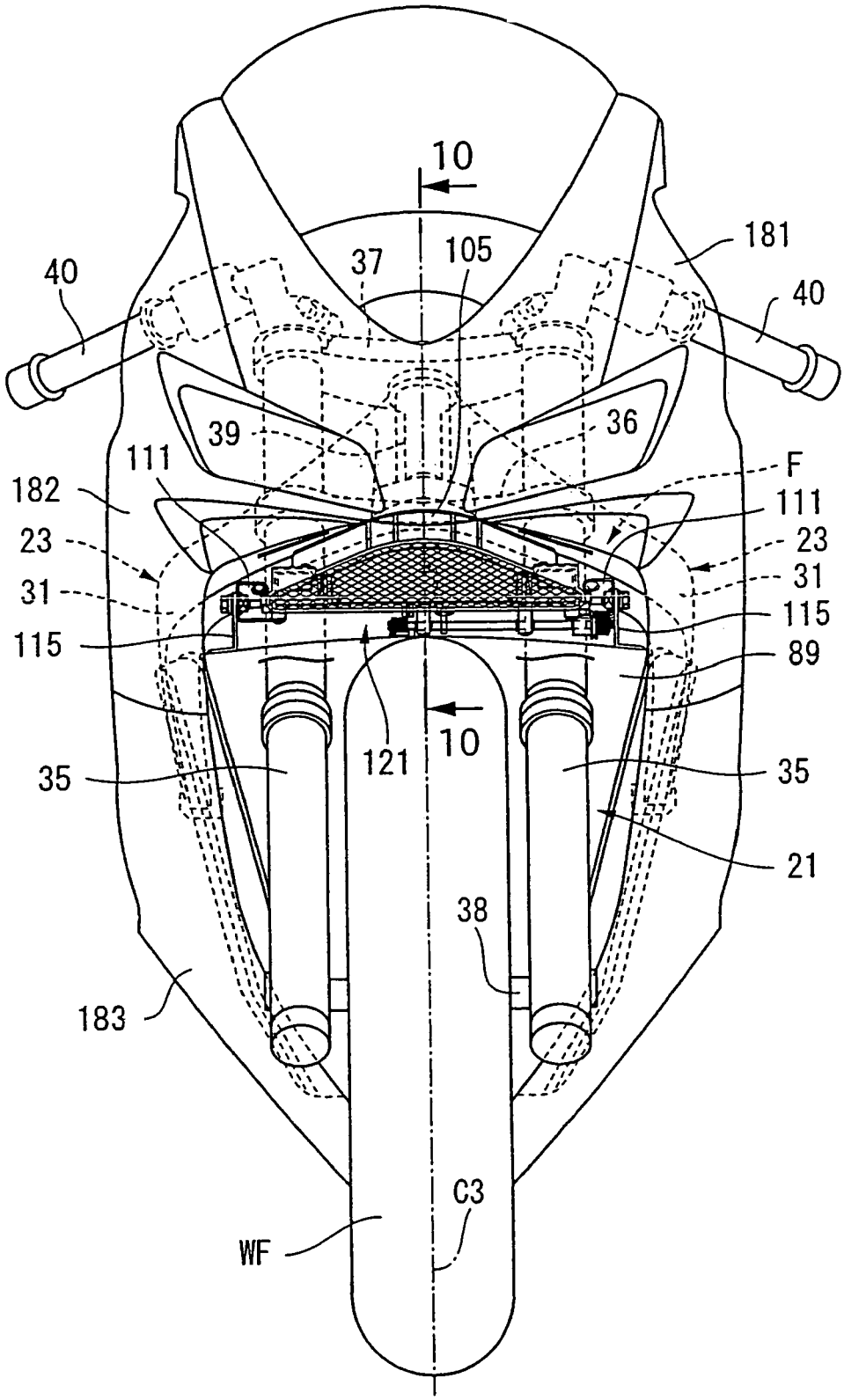
FIG. 6 is an enlarged view as taken in the direction of arrow 6 of FIG. 1.

In FIG. 6, the front fork 21 includes shock absorbers 35, 35 extending in the vertical direction on both the left and right sides of the front wheel WF with a bottom bridge 36 for connecting between both the shock absorbers 35, 35 on the upper side of the front wheel WF and a top bridge 37 for connecting between upper portions of both the shock absorbers 35, 35. An axle 38 of the front wheel WF is shaft-supported between lower end portions of both the shock absorbers 35, 35.

Figure 7:
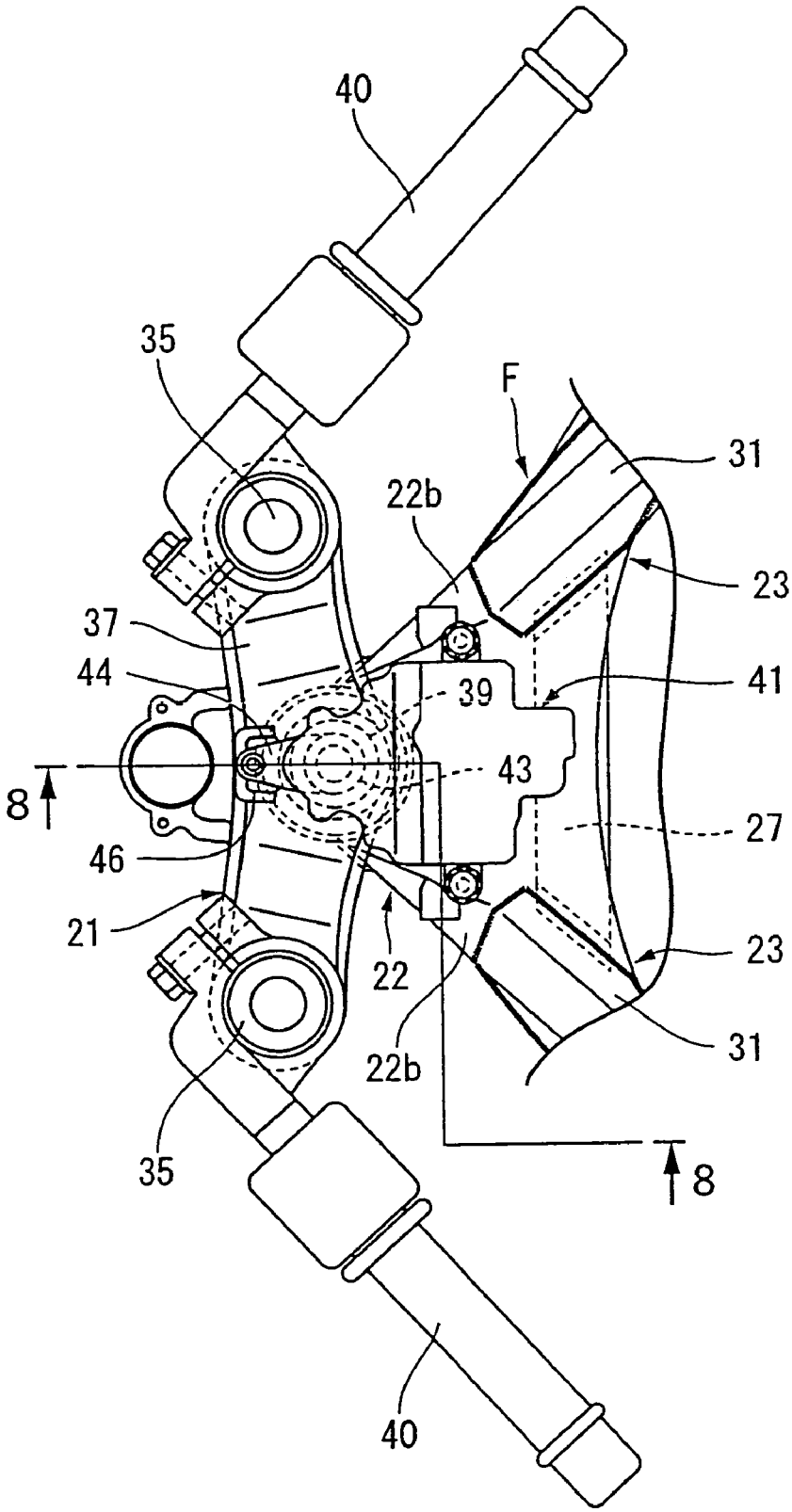
FIG. 7 is en enlarged view as taken in the direction of arrow 7 of FIG. 1.
Figure 8:
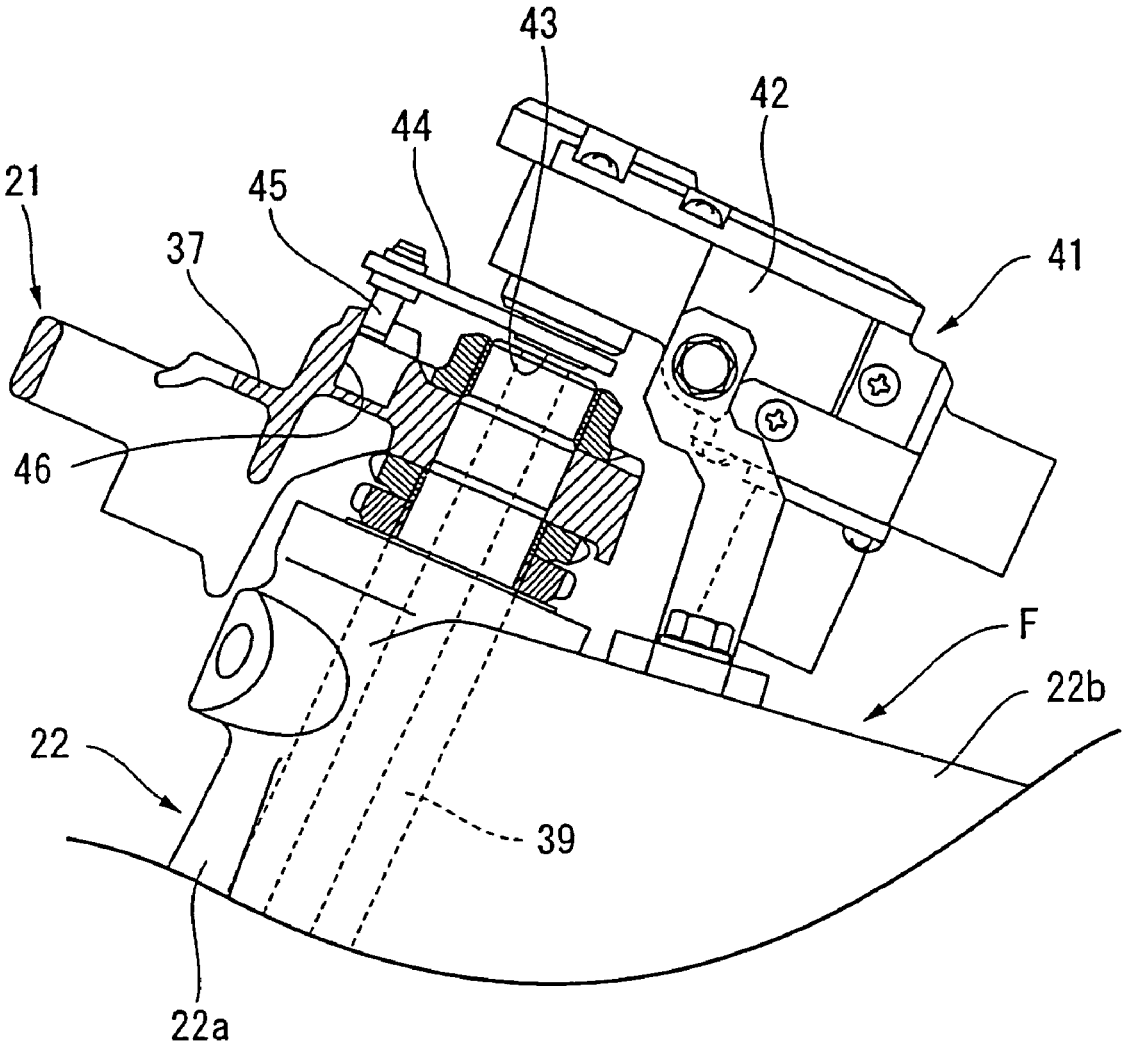
FIG. 8 is a sectional view as taken along line 8-8 of FIG. 7.

Referring to FIGS. 7 and 8, a steering shaft 39 parallel to both the shock absorbers 35, 35 is provided between the bottom bridge 36 and the top bridge 37 on the rear side of a central portion between both the shock absorbers 35, 35. In addition, the steering shaft 39 is turnably supported by the hollow cylindrical portion 22*a* of the head pipe 22.

Steering handles 40, 40 in the form of left and right individual bars are connected to top portions of both of the shock absorbers 35, 35 on the upper side of the bottom bridge 36. In addition, a steering damper 41 is provided between a front end portion of the vehicle body frame F, i.e., the head pipe 22 and the top bridge 37 in the front fork 21. The steering damper 41 includes a housing 42 fixedly supported on the head pipe 22 while incorporating a hydraulic damping mechanism (not shown) therein. A turnable shaft 43 is disposed on the upper side of and coaxially with the steering shaft 39 and is turnably supported on the housing 42. An arm 44 is provided having a base end portion fixed to the turnable shaft 43 and extending forwardly. An elastic roller 45 is provided that is shaft-supported on the tip end of the arm 44. A recessed portion 46 is provided in an upper surface of a central portion of the top bridge 37 for fitting therein the outer circumferential surface of the elastic roller 45 in a state of frictional contact.

Therefore, turning vibrations about the axis of the steering shaft 39 which are transmitted from the side of the front wheel WF to the top bridge 37 are transmitted through the arm 44, to be damped by the hydraulic damping mechanism in the housing 42.

In FIG. 2, an engine main body 50 of a multi-cylinder engine E including, for example, four cylinders arranged side by side in the width direction of the vehicle body frame F is supported on lower portions of both the engine hangers 24 . . . and upper and lower portions of both the pivot plates 26 . . . . The engine E is fastened to the lower portions of the engine hangers 24 . . . by left and right pairs of bolts 51 . . . .

Figure 9:
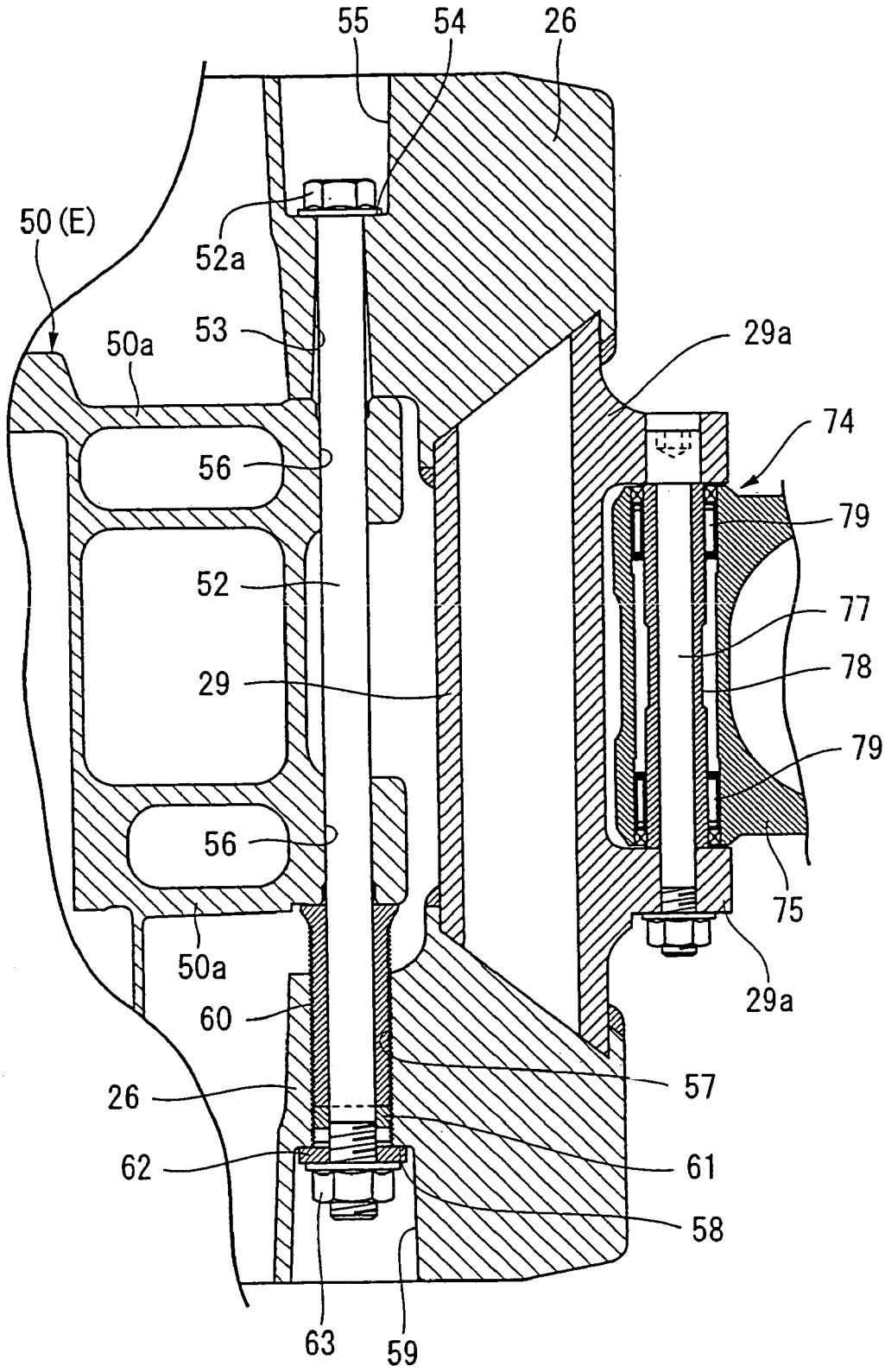
FIG. 9 is a sectional view as taken along line 9-9 of FIG. 2.

In FIG. 9, for supporting the engine main body 50 on the lower portions of the pair of pivot plates 26, 26 disposed on both sides of the engine main body 50, one of the pivot plates 26, 26 (in this embodiment, the pivot plate 26 disposed on the right side as viewed from a person facing the forward side of the motorcycle) is provided with a passing hole 53 for passing a mount bolt 52 therethrough, and with a first engaging and fixing portion 54 surrounding the outer end of the passing hole 53 for engagement with an enlarged diameter head portion 52*a* at one end of the mount bolt 52. More specifically, the pivot plate 26 on one side is provided at its lower portion with the passing hole 53 opened in an inside surface thereof and with a first insertion hole 55 larger in diameter than the passing hole 53 and opened in an outside surface thereof. The first engaging and fixing portion 54 is formed between the outer end of the passing hole 53 and the inner end of the first insertion hole 55, as an annular step portion fronting on the side of the first insertion hole 55.

In addition, the engine main body 50 is integrally provided with a pair of support arm portions 50*a*, 50*a* disposed between both the pivot plates 26, 26 in the state of being spaced from each other in the axial direction of the mount bolt 52. The support arm portions 50*a*, 50*a* are coaxially provided with through-holes 56, 56 for passing the mount bolt 52 therethrough.

The pivot plate 26 on the other side is provided at its lower portion with a screw hole 57 coaxial with the passing hole 53 and with a second engaging and fixing portion 58 surrounding the outer end of the screw hole 57. More specifically, the pivot plate 26 on the other side is provided at its lower portion with the screw hole 57 opened in an inside surface thereof and with a second insertion hole 59 larger in diameter than the screw hole 57 and opened in an outside surface thereof. The second engaging and fixing portion 58 is formed between the outer end of the screw hole 57 and the inner end of the second insertion hole 59 as an annular step portion fronting on the side of the second insertion hole 59.

A hollow cylindrical bolt 60 abutting on the engine main body 50 at one end thereof is screw-engaged in the screw hole 57. More specifically, in the condition where the support arm portion 50*a* on one side is in contact with the inside surface of the pivot plate 26 on one side, the hollow cylindrical bolt 60 is screw-engaged in the screw hole 57 with its one end abutting on the support arm portion 50*a* on the other side and a stop bolt 61 for preventing the loosening of the hollow cylindrical bolt 60 by abutting on the other end of the hollow cylindrical bolt 60 is screw-engaged in the screw hole 57. In addition, the hollow cylindrical bolt 60 and the stop bolt 61 are screw-engaged with the screw hole 57 so that the other end of the hollow cylindrical bolt 60 and the stop bolt 61 are located on the inner side relative to the second engaging and fixing portion 58 in the condition where the engine main body 50 is clamped between the inside surface of the pivot plate 26 on one side and the one end of the hollow cylindrical bolt 60.

The other end portion of the mount bolt 52, which is passed through the passing hole 53, both the through-holes 56, 56 in the engine main body 50, the hollow cylindrical bolt 60, the stop bolt 61 and the screw hole 57, projects from the screw hole 57. A nut 63, screw-engaged with the mount bolt 52 at the portion projecting from the screw hole 57, is engaged with the second engaging and fixing portion 58, with a washer 62 therebetween.

The support structure of supporting the engine main body 50 on the upper portions of both the pivot plates 26, 26 is basically the same as the support structure of supporting the engine main body 50 on the lower portions of the pivot plates 26, 26, and a detailed description thereof is therefore omitted.

A front end portion of a swing arm 66 is swingably supported, through a support shaft 67, on an intermediate portion in the vertical direction of each of the pivot plates 26, 26 and an axle 68 of a rear wheel WR is rotatably supported on a rear end portion of the swing arm 66.

Power from an output shaft 69 of a transmission incorporated in the engine main body 50 is transmitted to the rear wheel WR through a chain power transmission means 70. The chain power transmission means 70 is composed of a drive sprocket 71 fixed to the output shaft 69, a driven sprocket 72 fixed to the rear wheel WR and an endless chain 73 wound around the sprockets 71 and 72. The chain power transmission means 70 is disposed on the left side of the engine E as viewed from a person facing the forward side of the motorcycle.

A link mechanism 74 is provided between the third cross pipe 29 for connecting between lower portions of both the pivot plates 26, 26 and the swing arm 66. The link mechanism 74 includes a first link 75 connected to the third cross pipe 29 at one end portion thereof while being turnable about the axis of a first connection shaft 77 parallel to the support shaft 67 and a second link 76 which is connected to a lower portion of the swing arm 66 while being turnable about the axis of a second connection shaft 80 parallel to the first connection shaft 77 and which is connected to the other end portion of the first link 75 through a third connection shaft 81 parallel to the first and second connection shafts 77 and 80.

The third cross pipe 29 is integrally provided with a pair of shaft support portions 29*a*, 29*a* projecting to the rear side at two positions spaced from each other along the longitudinal direction thereof. The one end portion of the first link 75 is movably supported on a collar 78 mounted to the first connection shaft 77 provided between both the shaft support portions 29*a*, 29*a* through a pair of roller bearings 79, 79.

In addition, the other end portion of the first link 75 is connected to a rear portion of the second link 76 through the third connection shaft 81 and a lower end portion of a rear cushion unit 82 having an upper end portion connected to a bracket 66*a* provided at a front portion of the swing arm 66 is connected to a front portion of the second link 76 through a fourth connection shaft 83.

Figure 10:
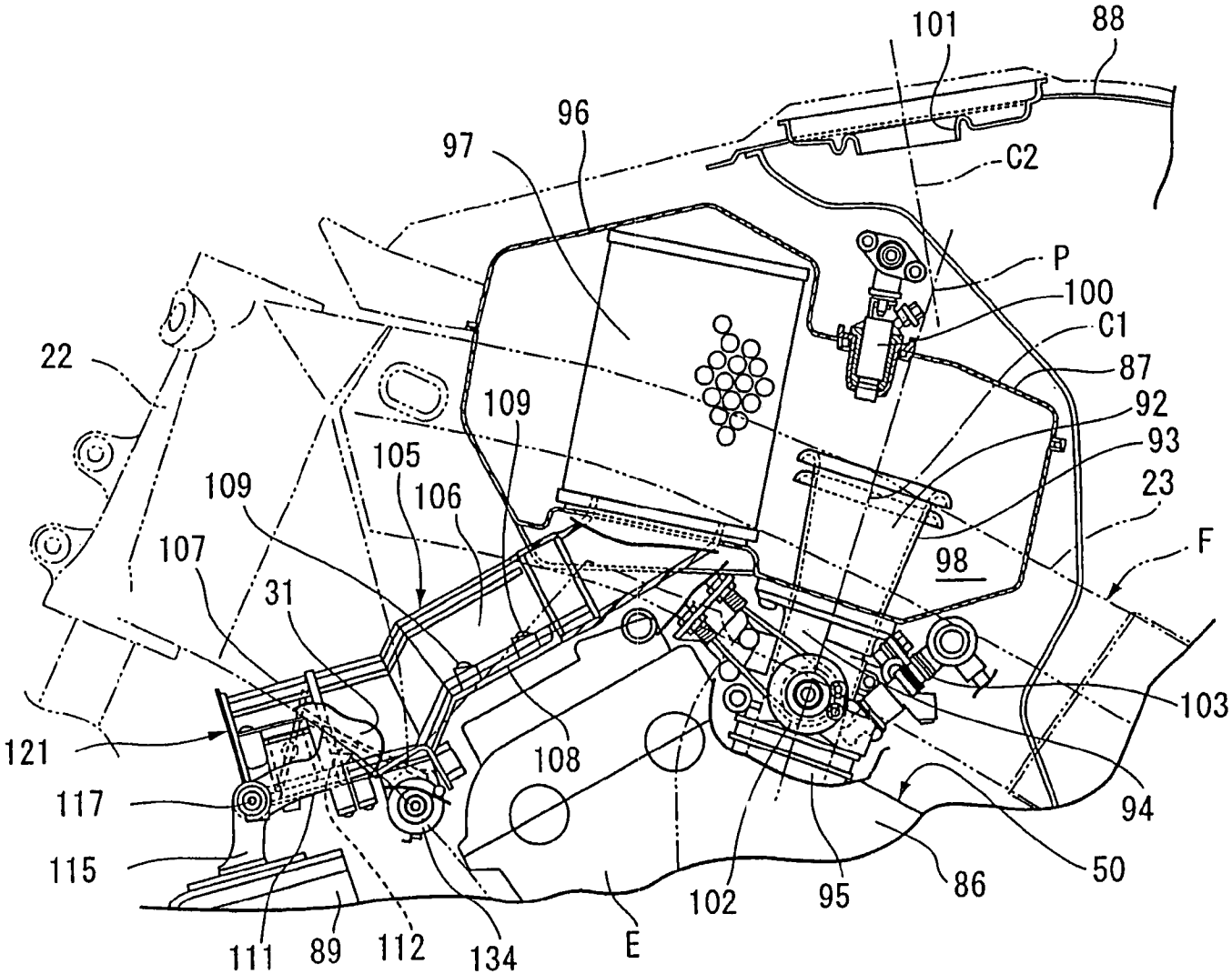
FIG. 10 is a sectional view as taken along line 10-10 of FIG. 6.
Figure 11:
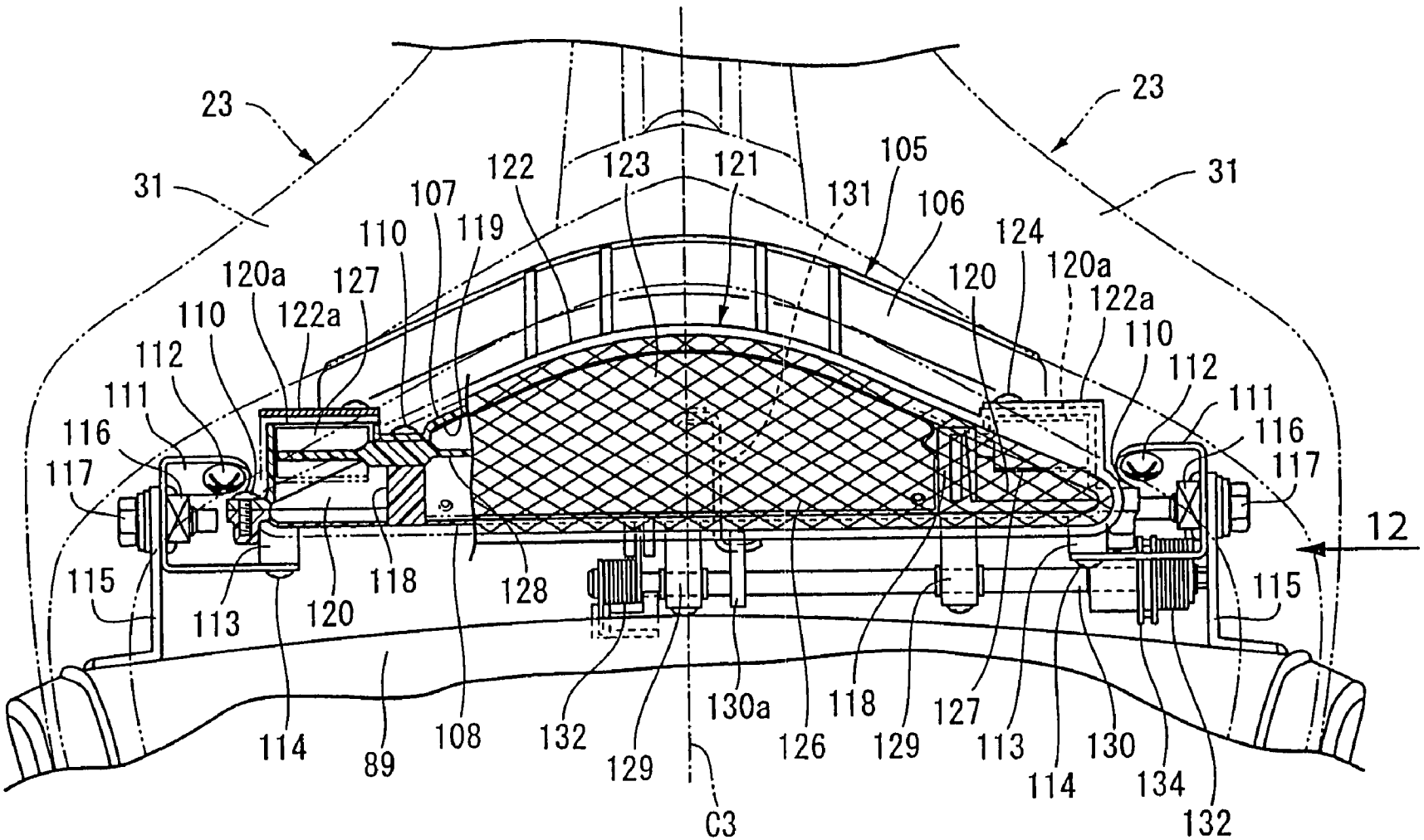
FIG. 11 is an enlarged view of an essential part of FIG. 6.
Figure 12:
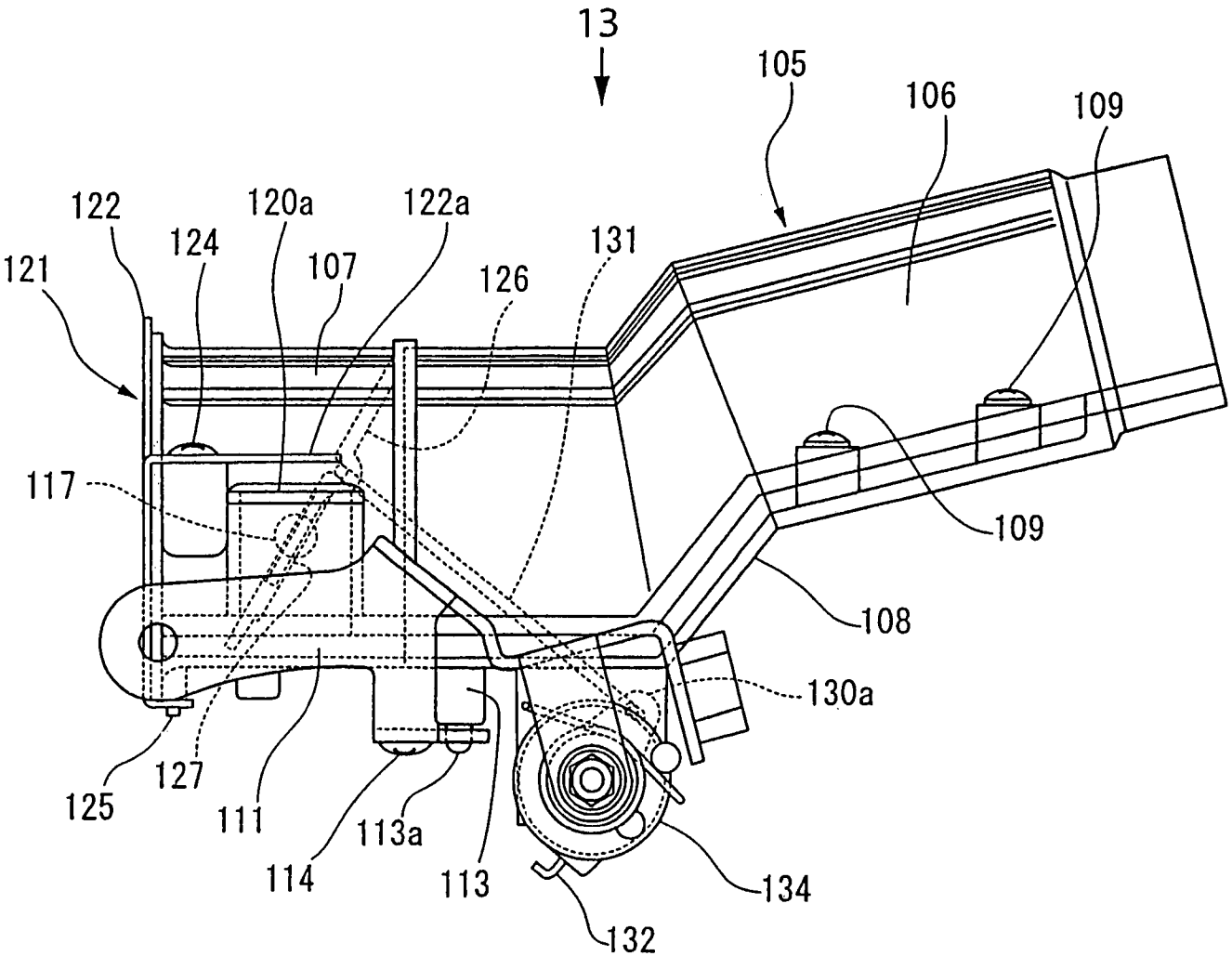
FIG. 12 is a view as taken in the direction of arrow 12 of FIG. 11.
Figure 13:
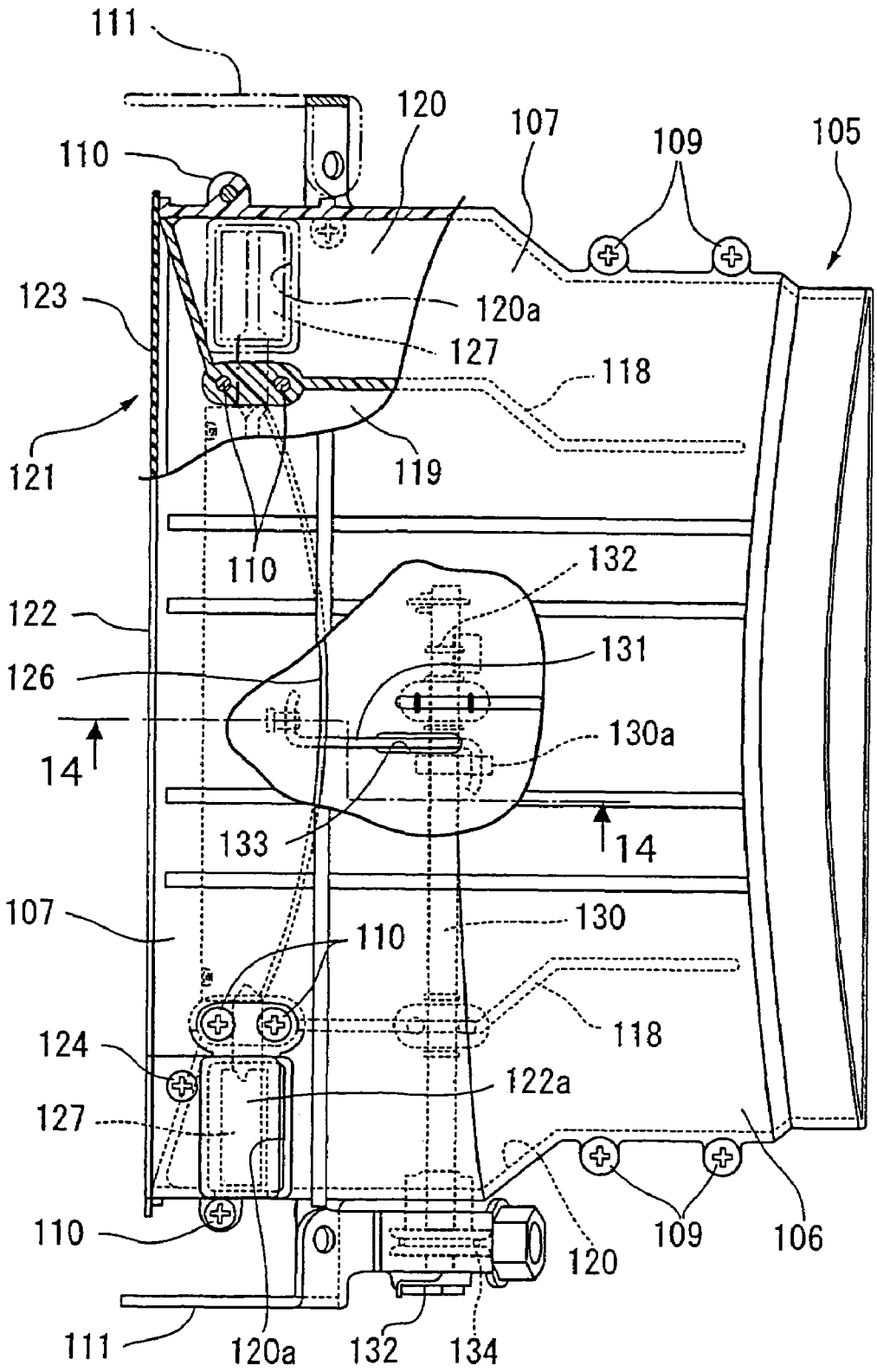
FIG. 13 is a partly cutout cross-sectional plan view along arrow 13 of FIG. 12.

Referring to FIG. 10, an air cleaner 87 for cleaning air supplied to the engine E is disposed on the upper side of a cylinder head 86 in the engine main body 50 so as to be located on the rear side of the head pipe 22 of the vehicle body frame F. A fuel tank 88 covering a rear portion and an upper portion of the air cleaner 87 is mounted on both the main frames 23 . . . of the vehicle body frame F with a radiator 89 being disposed on the front side of the engine main body 50. As shown in FIG. 2, a main seat 90 for seating the driver thereon is supported on the seat rail 30 on the rear side of the fuel tank 88 and a pillion seat 91 for seating the passenger thereon is supported on the seat rail 30 at a position spaced rearwardly from the main seat 90.

Intake passage portions 92 . . . extending rectilinearly so as to guide cleaned air from the air cleaner 87 on the upper side of the cylinder head 86 are connected to an upper side wall of the cylinder head 86 on a cylinder basis. The intake passage portion 92 includes a funnel 93 having an opened upper end portion projecting into the air cleaner 87 and a throttle body 94 connected to the lower end of the funnel 93. The throttle body 94 is connected to the upper side wall of the cylinder head 86 through an insulator 95.

On the other hand, the air cleaner 87 includes a hollow cylindrical cleaner element 97 fixedly contained in a cleaner case 96. Inside the cleaner case 96, a cleaning chamber 98 into which air cleaned by passing through the cleaner element 97 is formed around the cleaner element 97. The funnels 93 at the upstream ends of the intake passage portions 92 . . . are mounted, side by side, to the cleaner case 96 so as to open into the cleaning chamber 98.

Meanwhile, second injectors 100 for jetting a fuel at the time of high-speed rotation of the engine E are attached to the cleaner case 96 of the air cleaner 87, on the basis of each cylinder of the engine E. The second injectors 100 . . . are disposed on the front side of the center lines C1 . . . of the intake passage portions 92 . . . and are attached to the cleaner case 96 with their axes inclined against the center lines C1 . . . .

In addition, a fuel pump (not shown) is incorporated in the fuel tank 88 and the fuel is supplied from the fuel pump to the second injectors 100 . . . .

In addition, the fuel tank 88 is provided with an oil supply port 101 at a front portion thereof (see FIG. 10). The second injector 100 is disposed on the front side relative to the center line C2 of the oil supply port 101. The second injectors 100 . . . are attached to the cleaner case 96 so that their upper portions are disposed on the front side relative to the intersections P of the center line C2 of the oil supply port 101 and the center lines C1 of the intake passage portions 92 . . . on a projection onto a plane parallel to both the center lines C1 and C2.

Throttle valves (not shown) for controlling the quantities of intake air flowing through the intake passage portions 92 . . . are incorporated in the throttle bodies 94 . . . in the intake passage portions 92 . . . and a throttle drum 102 connected to each of the throttle valves is disposed on a lateral side of the throttle body 94. In addition, first injectors 103 . . . for jetting the fuel by being supplied with the fuel from the fuel pump in the fuel tank 88 in an operating condition of the engine E are mounted on the rear side of the throttle bodies 94 . . . on the engine E side relative to the throttle valves. The first injector 103 is provided on the opposite side of the layout position of the engine E and is fixed in the state of being inclined to the opposite side of the second injector 100 with respect to the center line C1.

Referring to FIGS. 11 to 14 also, an intake duct 105 for introducing outside air into the air cleaner 87 is disposed on the lower side of the head pipe 22 provided at the front end of the vehicle body frame F, in the manner extending forwardly from the air cleaner 87. A rear end portion of the intake duct 105 projects into and is fixed to a lower portion of the cleaner case 96 so as to introduce the outside air into the cleaner element 97 in the air cleaner 87.

The intake duct 105 is composed of a rear duct main body 106 having a roughly triangular cross-sectional shape having a central portion in the width direction projecting to the upper side and being open on the lower side. A front duct main body 107 is substantially the same as the rear duct main body 106 in cross-sectional shape and is joined to a front portion of the rear duct main body 106. A lower lid plate 108 is provided for closing the lower open ends of the front and rear duct main bodies 107 and 106. The intake duct 105 is so formed that the rear portion thereof is inclined rearwardly and upwardly as viewed from the lateral side. The lower lid plate 108 is fastened to the rear duct main body 106 with a plurality of screw members 109 . . . and is fastened to the front duct main body 107 with a plurality of screw members 110 . . . .

Support stays 111, 111 are fixed to front lower surfaces of the pipe members 31, 31 constituting parts of the main frames 23, 23 of the vehicle body frame F with screw members 112 . . . and mount bosses 113, 113 provided at both side lower portions of a front portion of the intake duct 105 are fastened to the support stays 111, 111 with screw members 114, 114, whereby the front portion of the intake duct 105 is supported on the vehicle body frame F. Moreover, positioning pins 113*a* . . . pass through the support stays 111 . . . and project from the mount bosses 113 . . . .

In addition, the radiator 89 is disposed on the lower side of the intake duct 105 and stays 115, 115 extend upwardly from both sides of the radiator 89. On the other hand, weld nuts 116, 116 are attached to the support stays 111, 111 and bolts 117, 117 pass through the stays 115, 115 and the support stays 111, 111 are screw-engaged with and fastened to the weld nuts 116, 116, whereby the radiator 89 is supported on the vehicle body frame F.

The lower lid plate 108 of the intake duct 105 is integrally provided with a pair of partition walls 118, 118 making contact with the lower surfaces of upper portions of the front and rear duct main bodies 107 and 106. Inside the intake duct 105, a first intake passage 119 of which a central portion in the width direction is disposed on the center line C3 in the width direction of the front wheel WF and a left-right pair of second intake passages 120, 120 disposed on both sides of the first intake passage 119 are formed so that the first intake passage 119 and the second intake passages 120, 120 are partitioned from each other by the partition walls 118, 118. The flow passage area of the first intake passage 119 is set to be greater than the total flow passage area of the pair of second intake passages 120, 120.

Moreover, front portions of both the partition walls 118, 118 are formed in the shape of being inclined away from each other in a forward direction with front end portions of both the partition walls 118, 118 being in contact with the inside surfaces of both side walls of the front duct main body 107. A front portion of the first intake passage 119 is opened in a forward direction at the front end of the intake duct 105 so as to occupy the whole part of a front opening portion of the intake duct 105. In addition, front end opening portions 120*a* . . . of the second intake passages 120, 120 are formed at a front end portion of the intake duct 105 so as to open in directions different from the opening direction of the front end of the first intake passage 119. In this embodiment, the front duct main body 107 is provided with the front end opening portions 120*a* . . . so as to open upwardly on both left and right sides of he front end portion of the first intake passage 119.

The front end portion of the intake duct 105 is formed in a roughly triangular shape with its upper edge set along the lower end edges of connection portions between the head pipe 22 and both the main frames 23, 23 and with its lower edge portion set along an upper portion of the radiator 89, as viewed from the front side. A grille 121 is mounted to the front end portion of the intake duct 105.

The grille 121 includes a net-like member 123 with peripheral portion being supported by a frame member 122 having a shape corresponding to the front end opening edge of the intake duct 105. The frame member 122 is integrally provided with baffle plates 122*a*, 122*a* disposed at positions spaced from front end opening portions 120*a* . . . of the second intake passages 120, 120 so as to form gaps between themselves and the front end opening portions 120*a* . . . . The baffle plates 122*a*, 122*a* are fastened to both sides of a front portion of the front duct main body 107 of the intake duct 105 with screw members 124, 124. In addition, positioning pins 125 . . . for inhibiting a lower portion of the frame member 122 from being disengaged from the front end portion of the intake duct 105 project on the front end of the lower lid plate 108 so as to be passed through the lower portion of the frame member 122.

A butterfly-shaped first intake control valve 126 is controlled to be opened and closed according to the rotating speed of the engine E so as to close the first intake passage 119 at the time of low-speed rotation of the engine E and to open the first intake passage 119 at the time of high-speed rotation of the engine E. The butterfly-shaped first intake control valve 126 is disposed inside the first intake passage 119. In addition, the butterfly-shaped second intake control valves 127 . . . that are controlled to be opened and closed according to the rotating speed of the engine E for opening the second intake passages 120 . . . at the time of low-speed rotation of the engine E and for closing the second intake passages 120 . . . at the time of high-speed rotation of the engine E are disposed inside the second intake passages 120 . . . . The first intake control valve 126 and the second intake control valves 127 . . . are fixed in common to a valve shaft 128 turnably supported on the intake duct 105 with its axis set orthogonal to the flow direction of air flowing through the first intake passage 119.

The valve shaft 128 is turnably supported on the partition walls 118, 118 at portions corresponding to the front end opening portions 120*a* . . . of the second intake passages 120 . . . in the intake duct 105. Of the plurality of screw members 110 . . . for fastening the front duct main body 107 to the lower lid plate 108, two pairs of screw members 110, 110 . . . are screwed into the partition walls 118, 118 at positions on both sides of the valve shaft 128.

Figure 14:
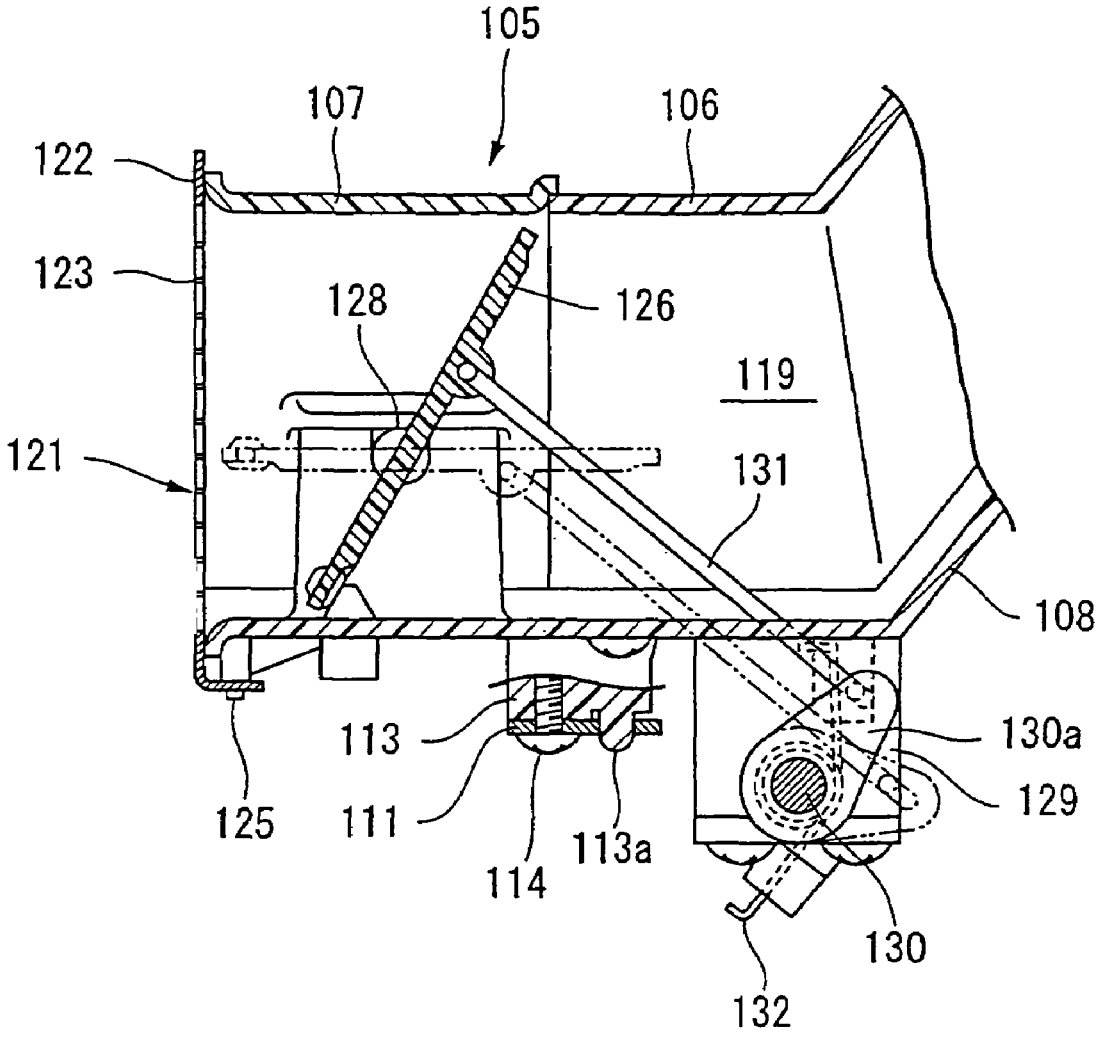
FIG. 14 is a sectional view as taken along line 14-14 of FIG. 13.

The first intake control valve 126 for varying the flow passage area of the first intake passage 119 is fixed to the valve shaft 128 so as to be inclined rearwardly and upwardly in the condition where the first intake passage 119 is closed, as shown in FIG. 14. Moreover, the first intake control valve 126 is so formed that, in the valve closing condition, the area of the portion on the upper side of the valve shaft 128 is greater than the area of the portion on the lower side of the valve shaft 128. In addition, the first intake control valve 126 is set substantially horizontal as indicated by the chain line in FIG. 14 so that its resistance to air flowing through the first intake passage 119 is minimized, in the valve opening condition.

The second intake control valves 127 . . . for varying the flow passage areas of the second intake passage 120 . . . are fixed to the valve shaft 128 so as to open the front end opening portions 120*a* . . . of the second intake passages 120 . . . in the condition where the first intake passage 119 is closed by the first intake control valve 126.

A turnable shaft 130 parallel to the valve shaft 128 is disposed on the lower side of the intake duct 105 on the rear side relative to the valve shaft 128. The turnable shaft 130 is turnably supported by a plurality of bearing portions 129 . . . projecting on the lower surface of the intake duct 105, namely, the lower surface of the lower lid plate 108.

The turnable shaft 130 is provided with an arm 130*a* at a portion corresponding to the first intake passage 119. A connection rod 131 passing through the lower portion of the intake duct 105, namely, through the lower lid plate 108 is connected at its one end to the first intake control valve 126 in the valve closing condition on the upper side relative to the valve shaft 128 and is connected at its other end to the arm 130*a*. Therefore, attendant on the turning of the turnable shaft 130, the first intake control valve 126 is turned between a valve closing position indicated by a solid line in FIG. 14 and a valve opening position indicated by a chain or broken line in FIG. 14.

Moreover, return springs 132, 132 for generating spring forces to turningly bias the turnable shaft 130 and the valve shaft 128 in such a direction as to put the first intake control valve 126 into the valve closing position are provided between both end portions of the turnable shaft 130 and the intake duct 105. In addition, a connection rod 131 movably passes through a through-hole 133 provided in the lower lid plate 108. The through-hole 133 is formed to be elongated in the front-rear direction, corresponding to the movement in the front-rear direction of the position at which the connection rod 131 passes through the lower lid plate 108 and attendant on the turning of the arm 130*a* together with the turnable shaft 130.

A driven pulley 134 is fixed to one end of the turnable shaft 130. A turning force is transmitted to the driven pulley 134 from an actuator 141 disposed on the left side of an upper portion of the engine main body 50 while being supported on one of support plate portions 33 . . . provided at rear portions of the main frames 23 . . . , through a first power transmission wire 135.

Figure 15:
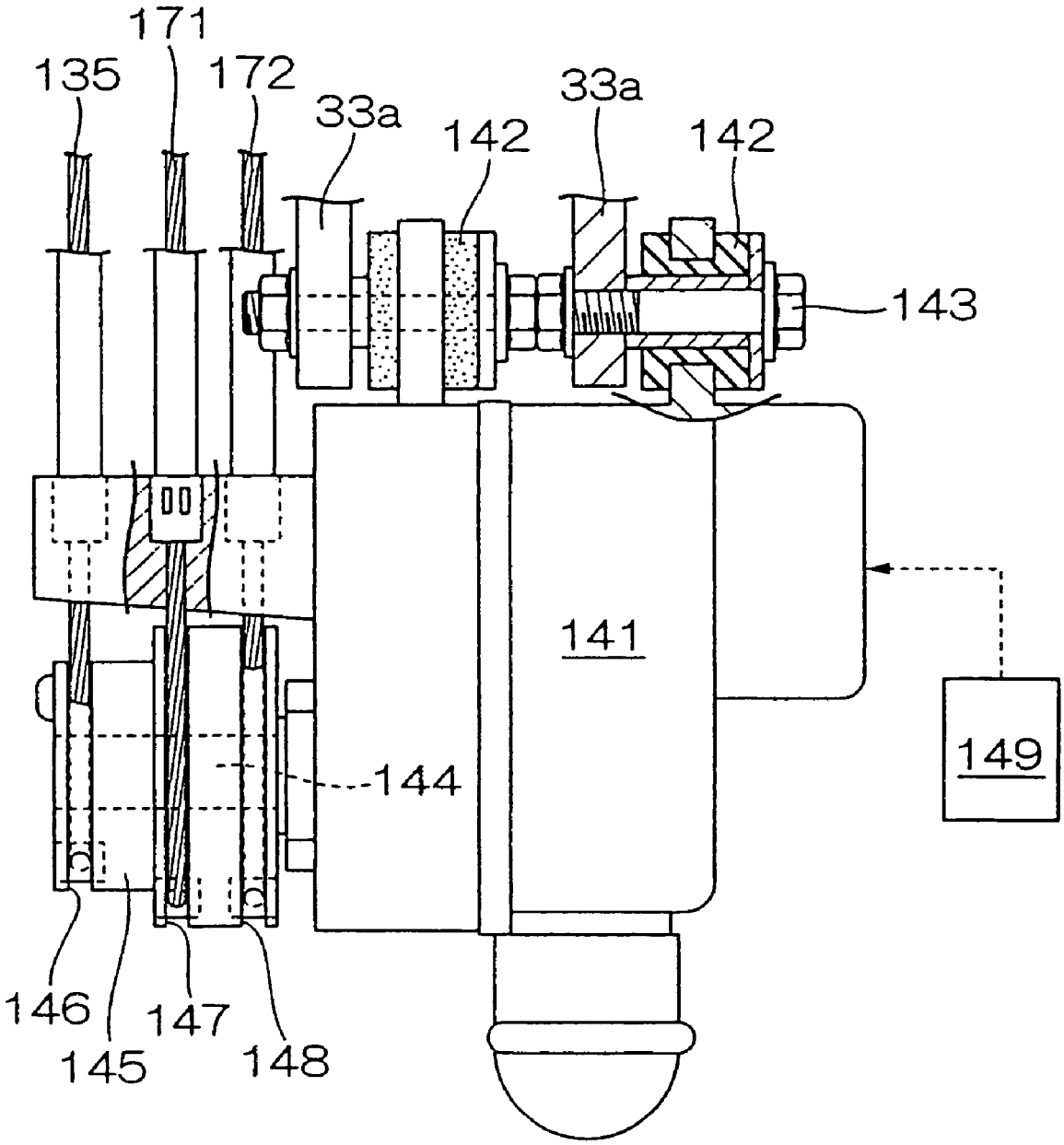
FIG. 15 is an enlarged view as taken along arrow 15 of FIG. 2.

In FIG. 15, the actuator 141 is composed of an electric motor capable of forward and reverse rotations and a speed reduction mechanism for speed-reducing the output of the electric motor. The actuator 141 is mounted to a pair of brackets 33*a*, 33*a* provided at the support plate portion 33 on one side in the vehicle body frame F, through elastic members 142, 142 with a bolt 143. A drive pulley 145 attached to an output shaft 144 provided in the actuator 141 is provided with a small-diameter first wire groove 146 and large-diameter second and third wire grooves 147 and 148.

An end portion of the first power transmission wire 135 for transmitting the turning force to the driven pulley 134 on the side of the intake duct 105 is wound around and engaged with the first wire groove 146.

An electronic control unit 149 is connected to the actuator 141 and the electronic control unit 149 controls the operation of the actuator 141 according to the rotating speed of the engine inputted from a sensor (not shown).

As illustrated in FIGS. 1 and 2, an exhaust system 150 continuous with the engine E includes individual exhaust pipes 151, 151 . . . connected individually to lower portions of a front-side side wall of the cylinder head 86 in the engine main body 50, a pair of first collection exhaust pipes 152 . . . for common connection of a pair of the individual exhaust pipes 151, 151. A single second collection exhaust pipe 153 is connected in common to the pair of first collection exhaust pipes 152 . . . and at an intermediate portion of which a first exhaust muffler 154 is interposed. A second exhaust muffler (muffler) 155 is connected to the downstream end of the second collection exhaust pipe 153.

The individual exhaust pipes 151, 151 . . . extend downwardly from the front side of the engine main body 50. The first collection exhaust pipe 152 . . . is disposed to extend substantially in the front-rear direction on the lower side of the engine main body 50. In addition, the second collection exhaust pipe 153 rises while being curved so as to extend from the lower side of the engine main body 50 toward the right side of the vehicle body, between the rear wheel WR and the engine main body 50 and extends rearwardly on the upper side of the rear wheel WR. In addition, the first exhaust muffler 154 is interposed at the rising portion of the second collection exhaust pipe 153 and a rear end exhaust portion of the exhaust system 150, i.e., a downstream end portion of the second exhaust muffler 155 is disposed on the upper side relative to the axle 68 of the rear wheel WR.

Figure 16:
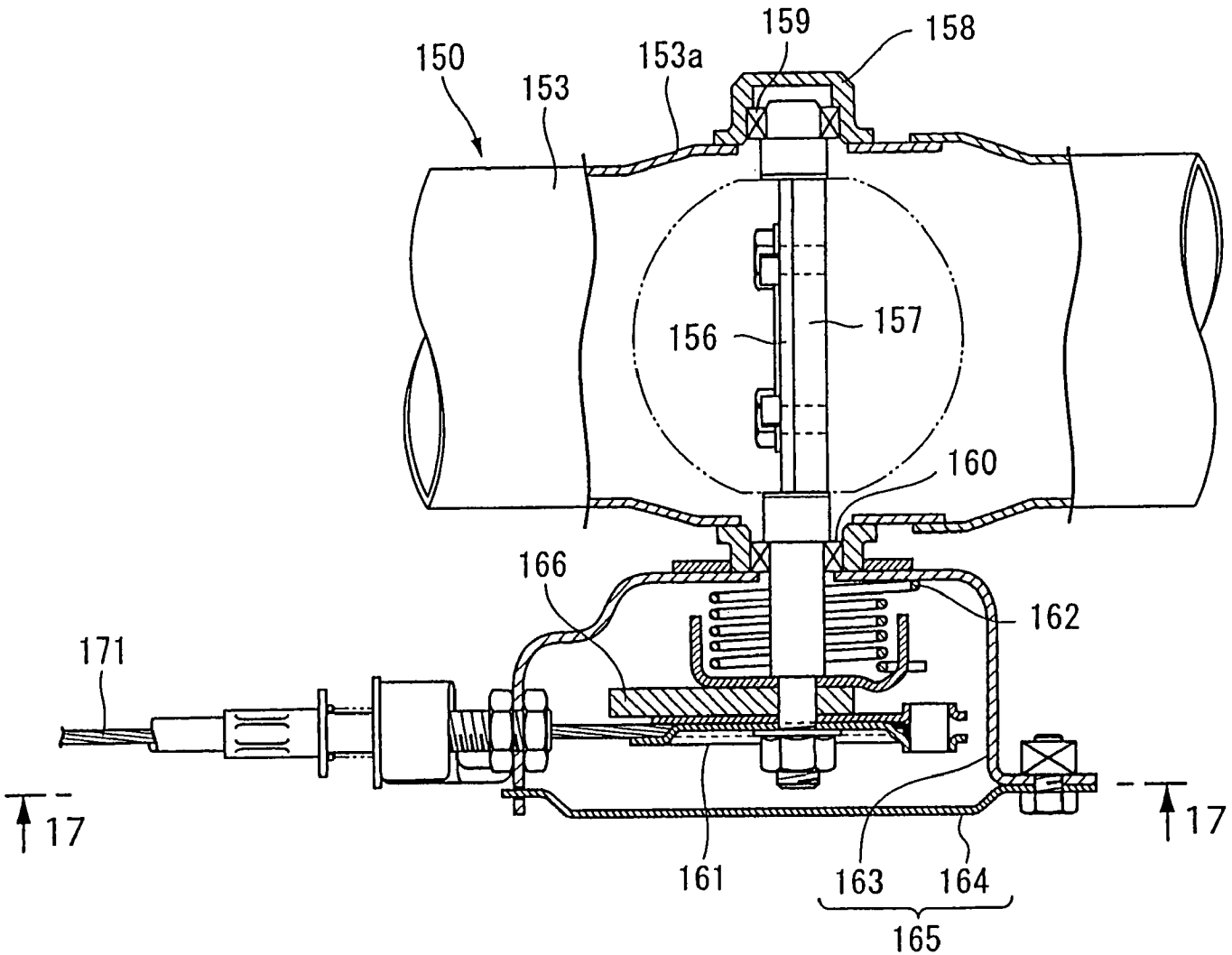
FIG. 16 is an enlarged sectional view as taken along line 16-16 of FIG. 2.
Figure 17:
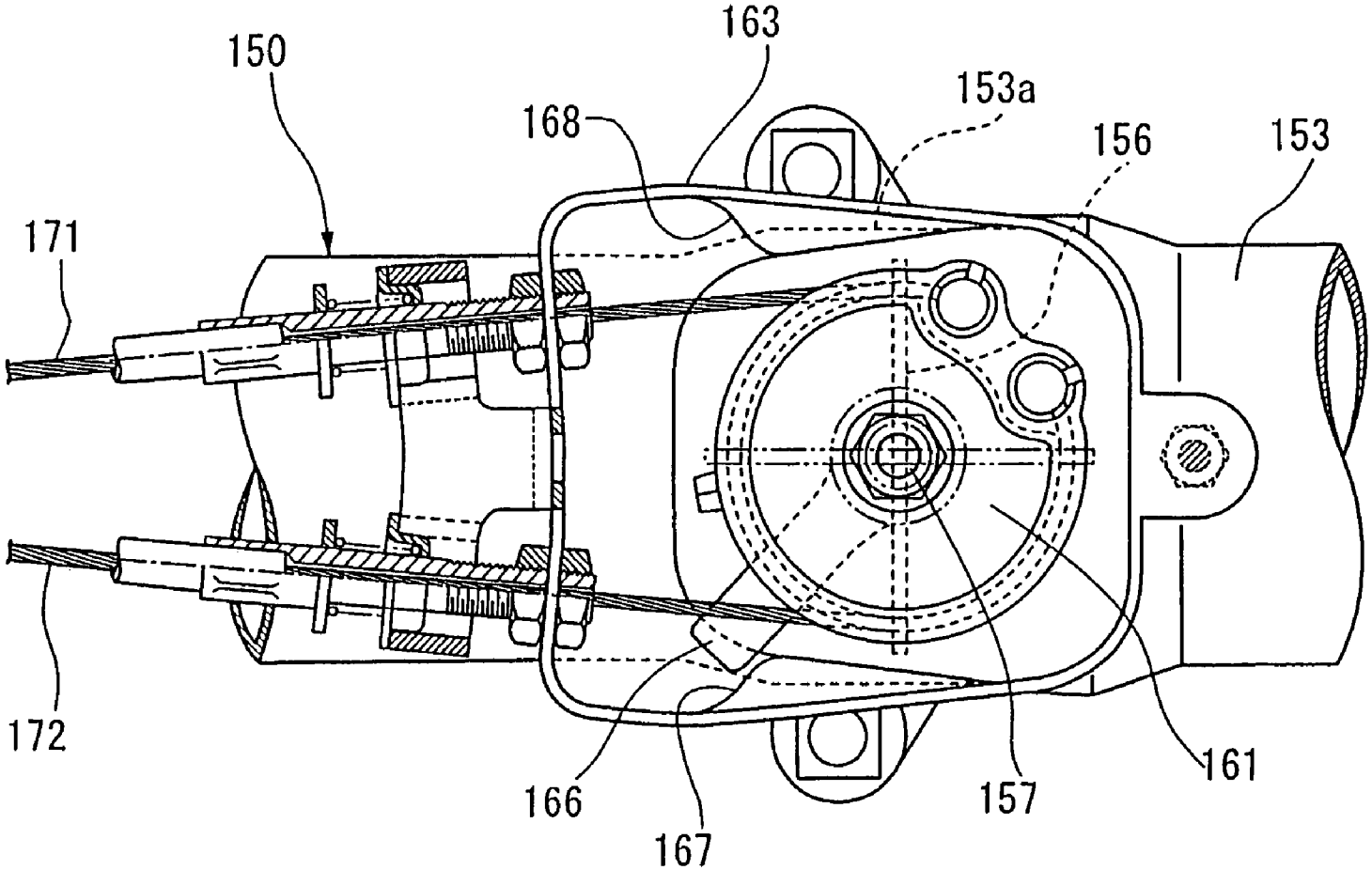
FIG. 17 is a sectional view as taken along line 17-17 of FIG. 16.

Referring to FIGS. 16 and 17, the second collection exhaust pipe 153 including a part of the exhaust system 150 is provided with an enlarged diameter portion 153*a* at a portion located on the front upper side of the axle 68 of the rear wheel WR. An exhaust control valve 156 is provided as an operating member for varying the flow passage area of the second collection exhaust pipe 153 according to the rotating speed of the engine E to thereby control the exhaust pulsation in the exhaust system 150 is disposed in the enlarged diameter portion 153*a*.

The exhaust control valve 156 is operated to the closing side for contriving enhancement of the output of the engine E by utilizing the exhaust pulsation effect in the exhaust system 150 in the low- and medium-rotation regions of the engine E, and is operated to the opening side for contriving enhancement of the output of the engine E by reducing the exhaust flow passage resistance in the exhaust system 150 in a high rotation region of the engine E. The exhaust control valve 156 is fixed to a valve shaft 157 turnably supported in the enlarged diameter portion 153*a* of the second collection exhaust pipe 153.

One end of the valve shaft 157 is movably supported, through a seal member 159, on a bottomed hollow cylindrical bearing housing 158 attached to the enlarged diameter portion 153*a*. A driven pulley 161 is fixed to the other end portion of the valve shaft 157 projecting from the enlarged diameter portion 153*a*, with a seal member 160 interposed between the valve shaft 157 and the enlarged diameter portion 153*a*. A return spring 162 for biasing the valve shaft 157 toward the side of opening the exhaust control valve 156 is provided between the valve shaft 157 and the enlarged diameter portion 153*a*.

Meanwhile, the portion of the valve shaft 157 projecting from the enlarged diameter portion 153*a*, the driven pulley 161 and the return spring 162 are contained in a case 165 which is composed of a bowl-shaped case main body 163 fixed to the enlarged diameter portion 153*a* and a lid plate 164 fastened to the case main body 163 so as to close the open end of the case main body 163.

Inside the case 165, a restriction arm 166 with a tip end portion projecting beyond the outer circumference of the driven pulley 161 is fixed to the valve shaft 157. The case main body 163 of the case 165 is provided on its inside surface with a closing-side stopper 167 for abutting with a tip end portion of the restriction arm 166 so as to restrict the end of turning of the valve shaft 157, namely, the exhaust control valve 156 toward the closing side, and with an opening-side stopper 168 for abutting with the tip end portion of the restriction arm 166 so as to restrict the end of turning of the valve shaft 157, namely, the exhaust control valve 156 toward the opening side.

One end portion of a second power transmission wire 171 for operating the exhaust control valve 156 toward the closing side at the time of traction is wound around and engaged with the driven pulley 161. In addition, one end portion of a third power transmission wire 172 for operating the exhaust control valve 156 toward the opening side at the time of traction is wound around and engaged with the driven pulley 161. As shown in FIG. 15, the other end portion of the second power transmission wire 171 is wound around and engaged with the second wire groove 147 in the drive pulley 145 of the actuator 141 in the direction opposite to the winding direction of the first power transmission wire 135 and the other end portion of the third power transmission wire 172 is wound around and engaged with the third wire groove 148 in the drive pulley 145 in the same direction as the winding direction of the first power transmission wire 135.

In other words, the actuator 141 for driving the exhaust control valve 156 which is controlled according to the rotating speed of the engine E is connected to the first intake control valve 126 in the intake duct 105 for the purpose of driving the first intake control valve 126 to rotate.

Meanwhile, of the second collection exhaust pipe 153, the enlarged diameter portion 153*a* in which the exhaust control valve 156 is disposed is preferably disposed on the lower side of the main seat 90 so as to obviate, as securely as possible, the problem that undesired external forces might be exerted on the second and third power transmission wires 171 and 172 from the upper side. In addition, the case 165 is disposed so as to be exposed to the exterior in a side view, in order to ensure that a running airflow will easily collide against the case 165.

The actuator 141 is desirably disposed on the rear upper side of the engine main body 50 at such a position that the distance between itself and the valve shaft 128 in the intake duct 105 is nearly equal to the distance between itself and the valve shaft 157 of the exhaust control valve 156. With this configuration, it is possible to reduce the number of obstacles interposed between the driven pulley 161 of the exhaust control valve 156 and the actuator 141, and to facilitate the laying of the second and third power transmission wires 171 and 172 for connection between the driven pulley 161 and the actuator 141.

Figure 18:
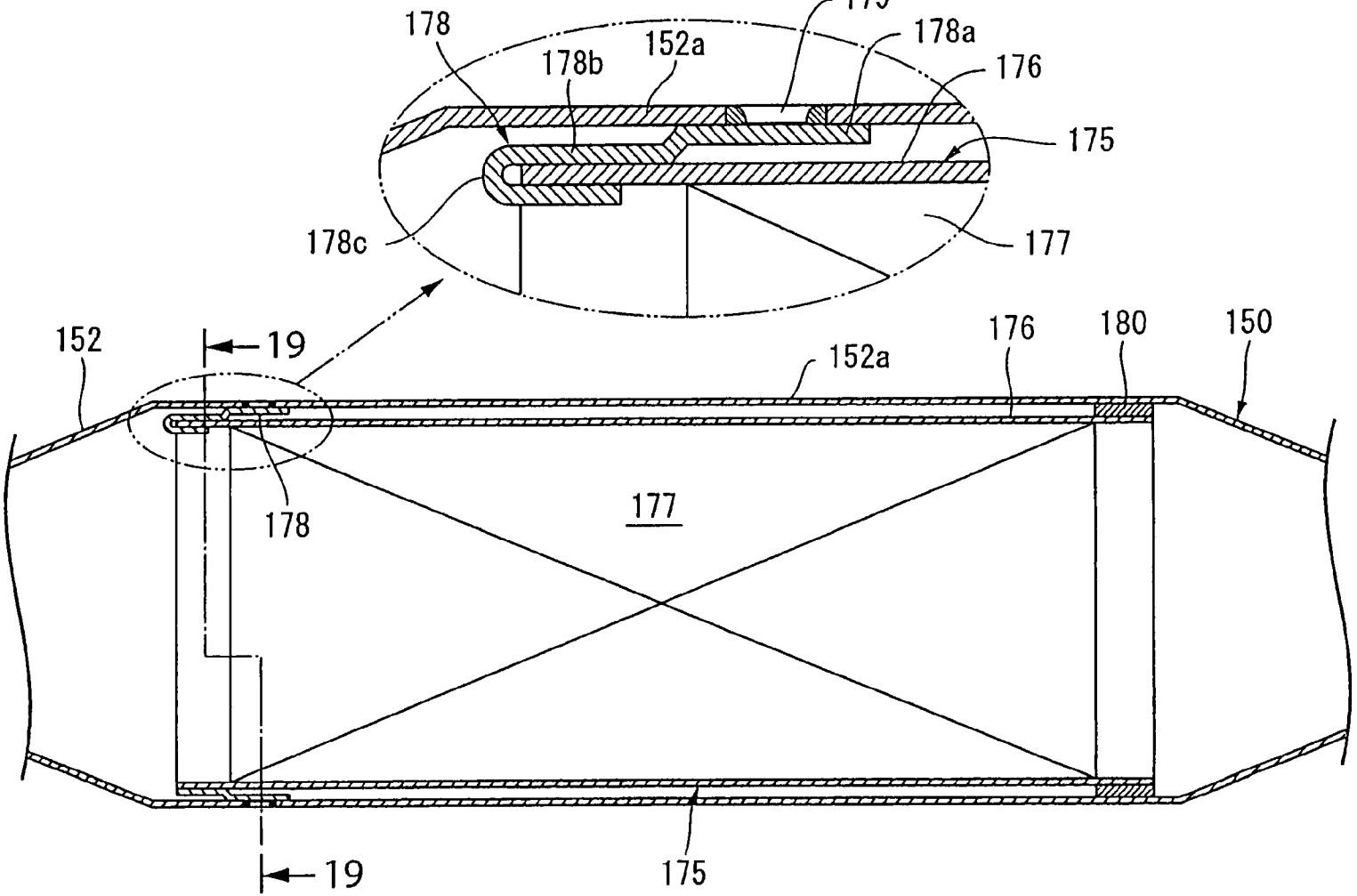
FIG. 18 is an enlarged sectional view as taken along line 18-18 of FIG. 2.
Figure 19:
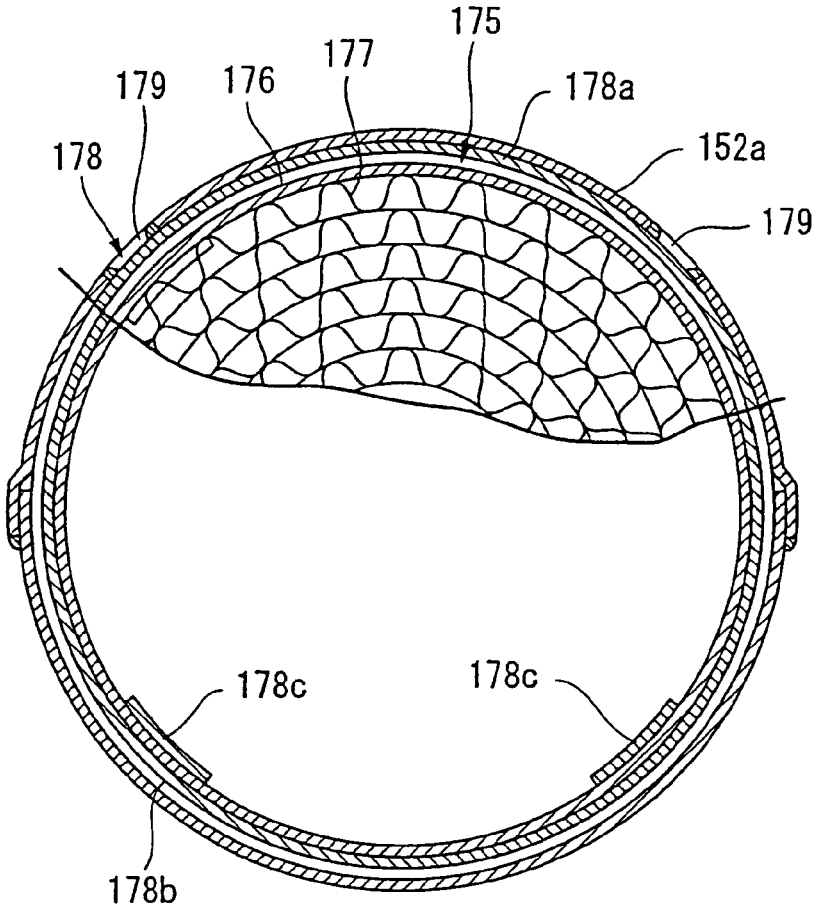
FIG. 19 is a sectional view as taken along line 19-19 of FIG. 18.

In FIGS. 18 and 19, the first collection exhaust pipes 152 . . . constituting parts of the exhaust system 150 are provided with the enlarged diameter portions 152*a* . . . at portions located on the lower side of the engine main body 50. A catalyst body 175 is contained in each of the enlarged diameter portions 152*a* . . . . With the catalyst body 175 thus disposed on the lower side of the engine main body 50, the exhaust gas discharged from the cylinder head 86 can flow through the catalyst body 175 as it is at a comparatively high temperature.

The catalyst body 175 has a structure in which a catalyst carrier 177 formed in a cylindrical shape while permitting the flow of the exhaust gas is contained in a hollow cylindrical case 176, with its one end disposed on the inner side relative to one end of the case 176. The case 176 is formed of a material different from the material of the first collection exhaust pipe 152. For example, while the first collection exhaust pipe 152 is formed of titanium, the case 176 and the catalyst carrier 177 of the catalyst body 175 are made of a stainless steel.

A bracket 178 formed of the same material as the first collection exhaust pipe 152, for example, titanium, is welded to the inner circumferential surface of the enlarged diameter portion 152*a* of the first collection exhaust pipe 152. The bracket 178 integrally includes a large ring portion 178*a* fitted in the enlarged diameter portion 152*a* while surrounding one end portion of the case 176, a small ring portion 178*b* continuous with the large ring portion 178*a* so that one end of the case 176 is fitted therein and extending arm portions 178*c*, 178*c* . . . extending towards the opposite side of the large ring portion 178*a* from a plurality of locations, for example, four locations equally spaced along the circumferential direction, of the small ring portion 178*b*.

Through-holes 179 . . . are provided at a plurality of locations in the circumferential direction of the enlarged diameter portion 152*a* so that the outer circumferential surface of the large ring portion 178*a* fronts thereon. The large ring portion 178*a* is welded to the enlarged diameter portion 152*a* at the through-holes 179 . . . , whereby the bracket 178 is welded to the enlarged diameter portion 152*a* of the first collection exhaust pipe 152. In addition, each of the extended arm portions 178*c*, 178*c* . . . is caulked to one end of the case 176 of the catalyst body 175 and the bracket 178 welded to the enlarged diameter portion 152*a* of the first collection exhaust pipe 152 is caulked to one end of the case 176 at portions protruding beyond one end of the catalyst carrier 177.

In addition, a ring 180 composed of stainless steel mesh is attached to the outside surface of the other end of the case 176 of the catalyst body 175 by spot welding. The ring 180 is interposed between the enlarged diameter portion 152*a* of the first collection exhaust pipe 152 and the other end portion of the case 176, whereby the other end side of the catalyst body 175 fixed to the enlarged diameter portion 152*a* through the bracket 178 on one end side thereof can be slid through thermal expansion. Therefore, it is possible to obviate a problem wherein a stress due to thermal expansion of the catalyst body 175 might be exerted between the one end portion of the catalyst body 175 and the enlarged diameter portion 152*a*.

As illustrated in FIG. 1, the front side of the head pipe 22 is covered with a front cowl 181 formed of a synthetic resin with both sides of a front portion of the vehicle body being covered with a synthetic resin-made center cowl 182 continuous with the front cowl 181. A synthetic resin-made lower cowl 183 is provided for covering the engine main body 50 from both sides is provided in continuity with the center cowl 182. In addition, a rear portion of the seat rail 30 is covered with a rear cowl 184.

A front fender 185 for covering the upper side of the front wheel WF is mounted to the front fork 21 and a rear fender 186 for covering the upper side of the rear wheel WR is mounted to the seat rail 30.

The second exhaust muffler 155 at a rear portion of the exhaust system 150 extends rearwardly from the engine E and is disposed in a rear portion of the rear cowl 184. A rear end surface of the second exhaust muffler 155 is covered with a resin-made muffler rear cover 187 which will be described later.

Figure 20:
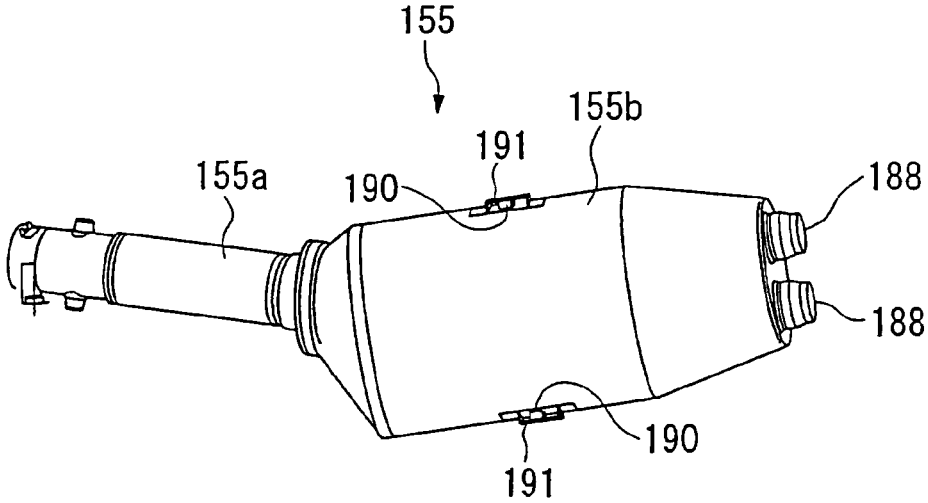
FIG. 20 is a plan view of a second exhaust muffler.
Figure 21:
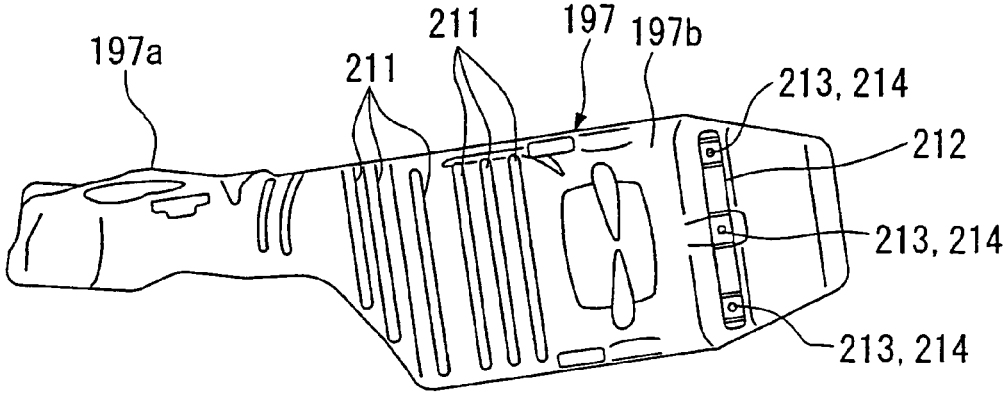
FIG. 21 is a plan view of a muffler protector.
Figure 23:
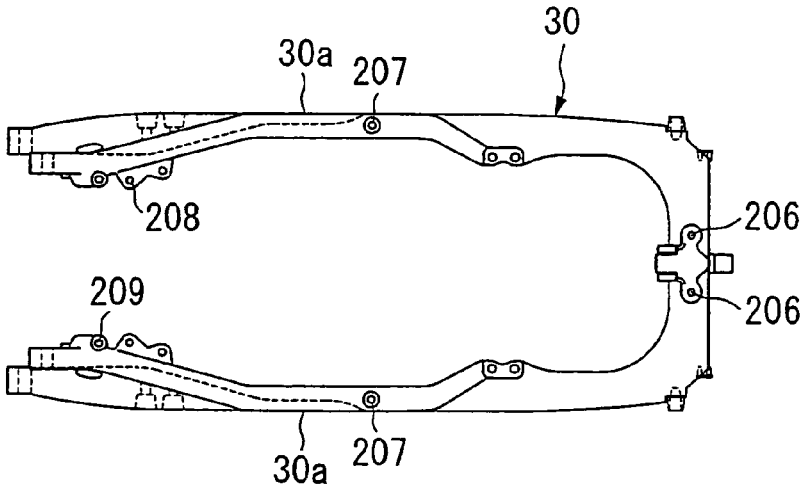
FIG. 23 is a plan view of a seat rail.
Figure 24:
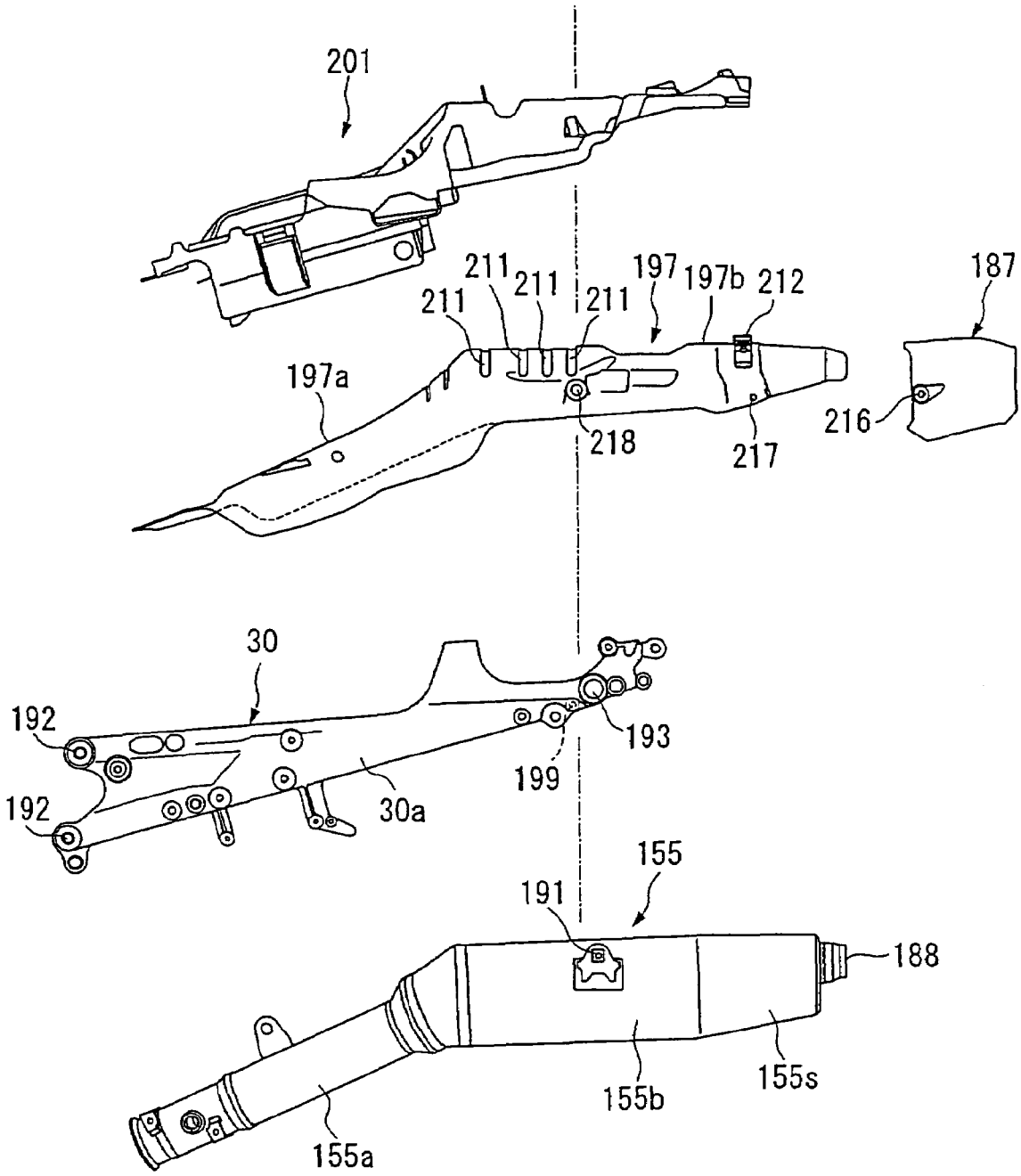
FIG. 24 is a side view showing a disassembled state of FIG. 25.

As shown in FIGS. 20 and 24, the second exhaust muffler 155 includes a piping portion 155*a* connected to the second collection exhaust pipe 153. A muffler main body 155*b* is connected to the piping portion 155*a*. In FIGS. 20 to 25, the left side is the front side of the vehicle body and the right side is the rear side of the vehicle body.

Figure 26:
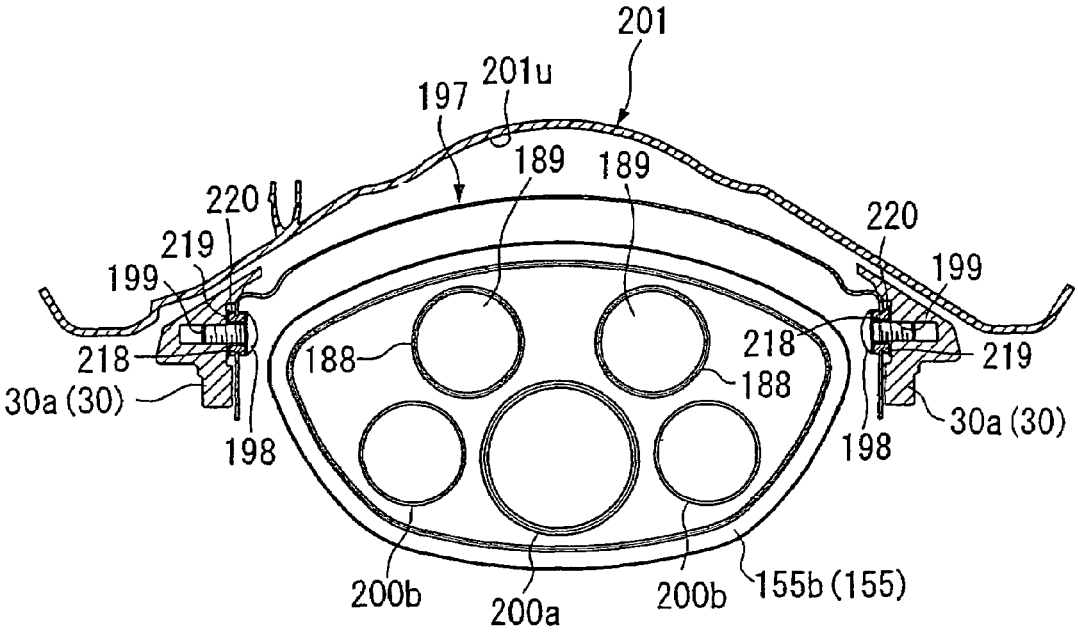
FIG. 26 is a sectional view as taken along line 26-26 of FIG. 25.
Figure 27:
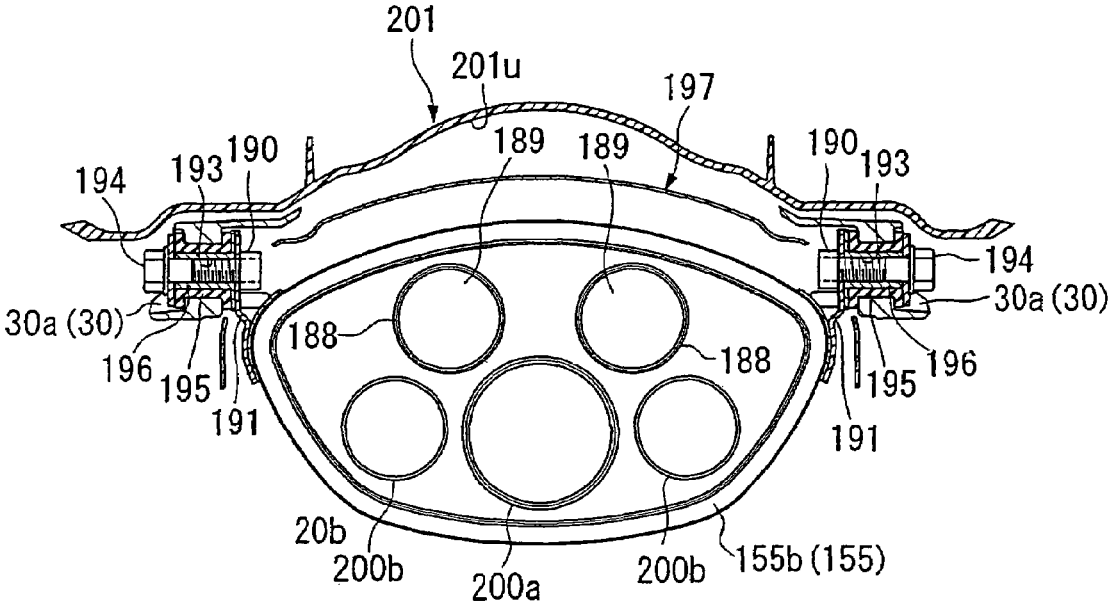
FIG. 27 is a sectional view as taken along line 27-27 of FIG. 25.
Figure 28:
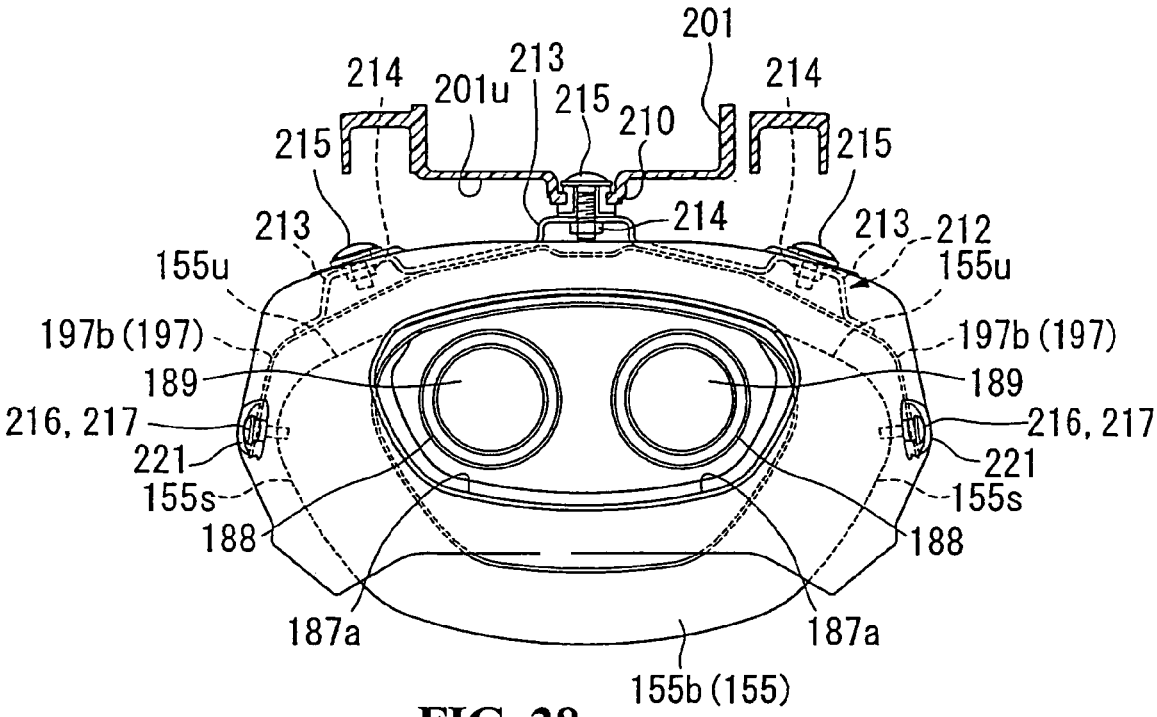
FIG. 28 is a view as taken along arrow 28 of FIG. 25.
Figure 29:
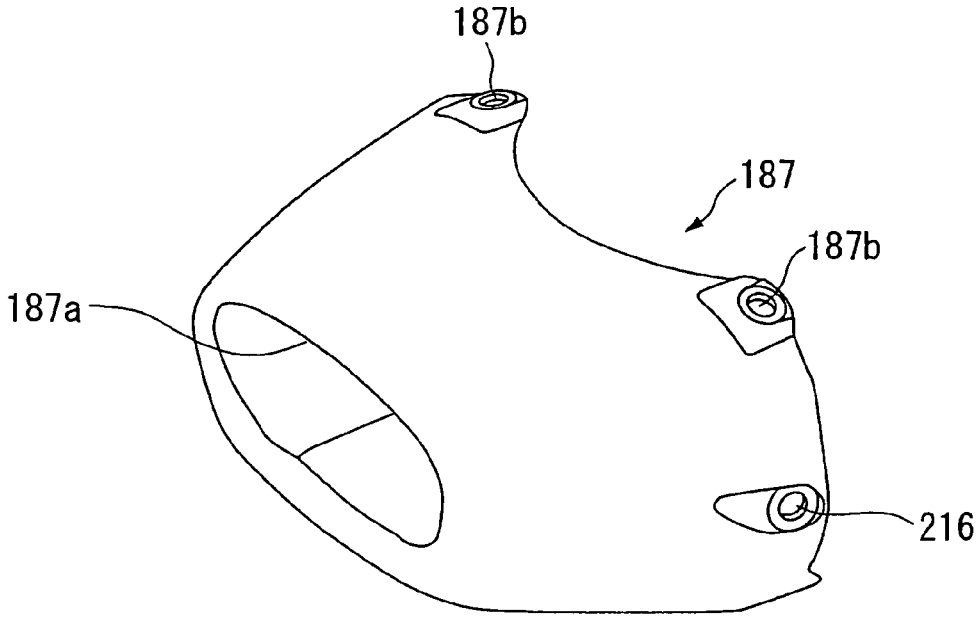
FIG. 29 is a perspective view of a muffler rear cover.

As shown in FIGS. 26 to 28 also, a muffler main body 155*b* is a flat-shaped member in which two tail pipes 188 are disposed in the vehicle width direction with their opening portions (rear opening portions) 189 directed rearwardly. With the muffler main body 155*b* provided with such a flat shape, the passage route for the exhaust gas passing therethrough is secured to be longer in the vehicle width direction, the sound insulating effect is thereby enhanced, and, by enlarging the size in the vehicle width direction, it is possible to reduce the front-rear length while securing the volume which greatly affects the sound insulating effect. In addition, a rear portion of the muffler main body 155*b* is a little tapered, to be continuous, on an appearance basis, with a vehicle body rear portion tapered toward the rear side.

In addition, brackets 191 with weld nuts 190 fixed on the back side thereof are formed at both side portions of the muffler main body 155*b* and the muffler main body 155*b* is fixed to the seat rail 30 through the brackets 191.

As shown in FIGS. 23 and 24, the seat rail 30 is a member which is triangular in a side view and is a frame-like shape opened on the front side in a plan view. The seat rail 30 includes a pair of side arm portions 30*a* extending in a forward direction. Upper portions of the front ends of the side arm portions 30*a* are displaced inwardly, and each of the side arm portions 30*a* is provided with a plurality of mount holes formed in inside and outside surfaces thereof. The seat rail 30 is provided at its front end portions with mount portions 192 for mounting to the main frames 23.

More specifically, a rear portion of the side arm portion 30*a* is provided with a mount hole 193 at a position corresponding to the bracket 191 of the muffler main body 155*b*. As shown in FIG. 27, a bolt 194 is passed through the mount hole 193 in the seat rail 30 from the outer side toward the inner side. The bolt 194 is fastened and fixed through a rubber bushing 195 and a collar 196. The rubber bushing 195 can prevent the vibrations of the second exhaust muffler 155 from being transmitted to the vehicle body. In addition, on the front side of the mount hole 193 for mounting the bracket 191 of the muffler main body 155*b*, a mount hole 199 is formed for mounting a muffler protector 197 by a bolt 198, a collar 219 and a grommet 220 from the inner side, as shown in FIG. 26. In FIGS. 27 and 26, inner pipes symbols 200*a*, 200*b*, 200*b* are contained in the inside of the muffler main body 155*b*.

Figure 22:
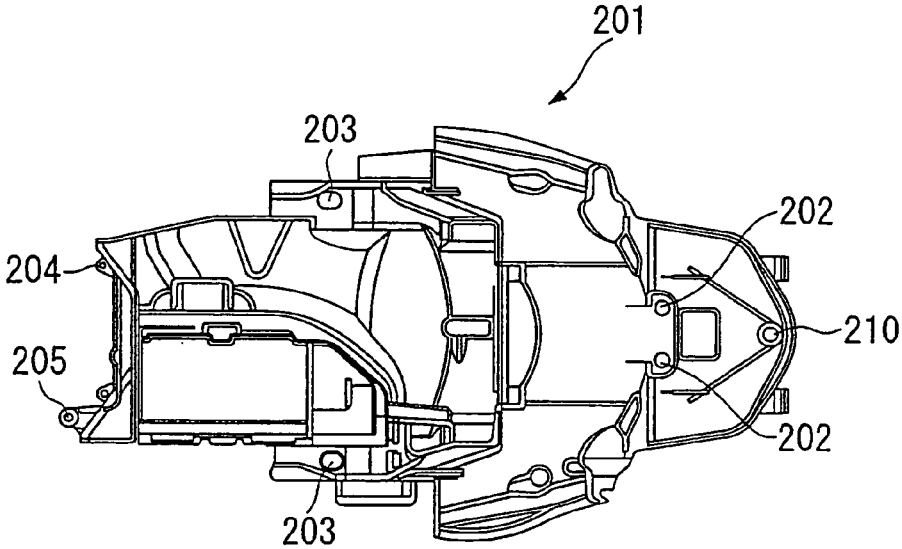
FIG. 22 is a plan view of a rear fender upper.
Figure 25:
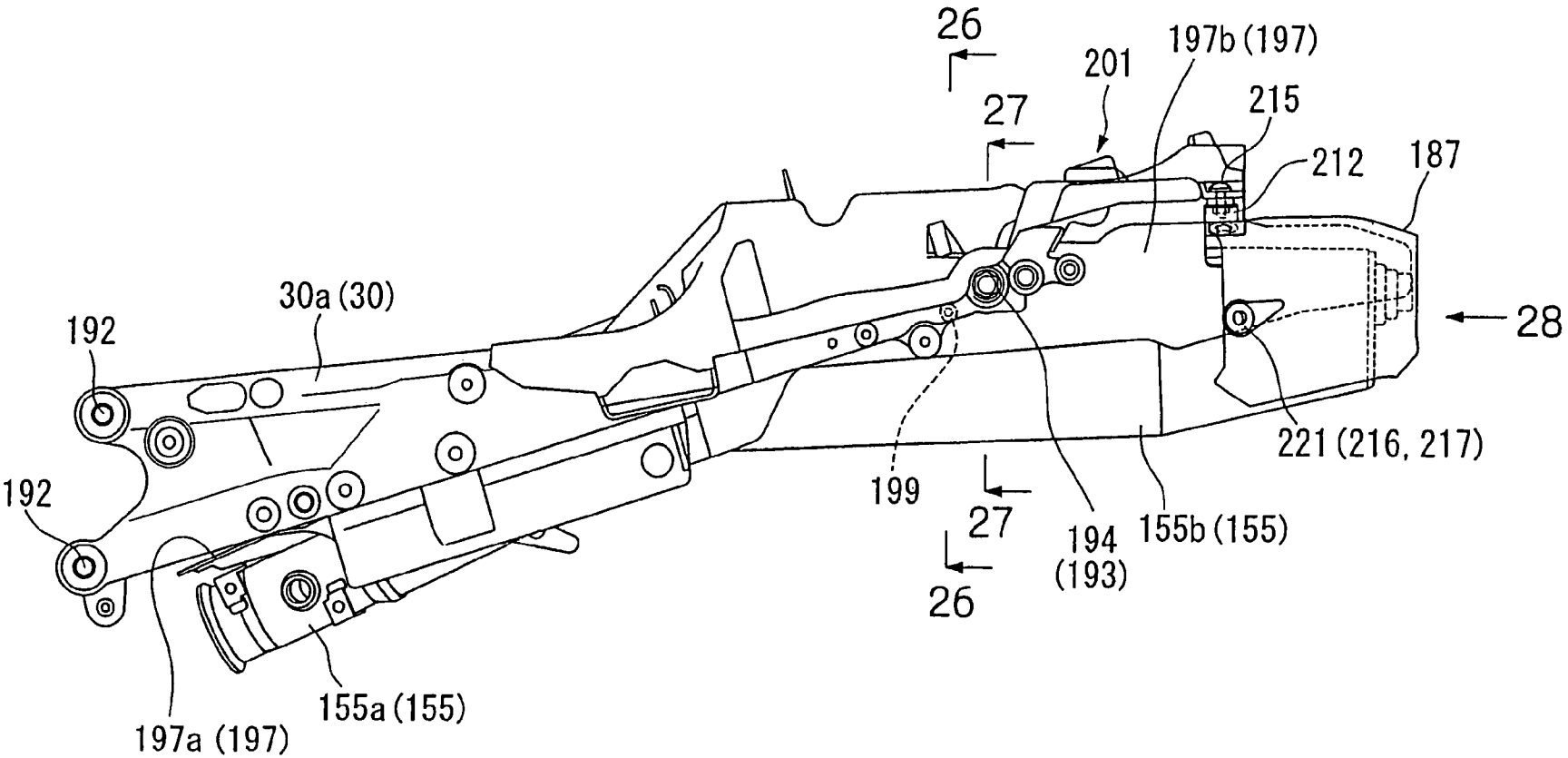
FIG. 25 is a side view showing an assembled state of the portions at and around the second exhaust muffler.

As shown in FIGS. 22, 24 and 25, a rear fender upper (rear fender) 201 formed of resin or the like is provided at a position for being covered by the rear cowl 184 from both sides so as to cover the seat rail 30 from the upper side.

The rear fender upper 201 is a member which is exposed to the lower side when the main seat 90 and the pillion seat 91 are removed. As shown in FIG. 22, the rear fender upper 201 is provided with two rear mount portions 202, 202 at central portions of a rear portion thereof, with side mount portions 203, 203 at both sides thereof and with front end mount portions 204, 205 at front end portions thereof. The rear fender upper 201 is mounted to rear end mount portions 206, 206, side mount portions 207, 207 and front mount portions 208, 209 of the seat rail 30 shown in FIG. 23, respectively, by fixing means (not shown). As shown in FIGS. 22 and 28, the rear fender upper 201 is provided in the upper surface of a rear end portion thereof with a recessed mount seat 210 for the muffler protector 197 which will be described later.

As shown in FIGS. 21, 24, 25 and 28, at a lower position spaced from the rear fender upper 201 by a predetermined interval, the muffler protector 197 made of a metal (for example, aluminum) for receiving the heat from the second exhaust muffler 155 is provided in a state of covering the lower surface 201*u* of the rear fender upper 201 while extending astride the rear cowl 184. The muffler protector 197 is shaped along the second exhaust muffler 155, and, more specifically, is composed of an extended portion 197*a* for covering the piping portion 155*a* of the second exhaust muffler 155. A heat insulating portion 197*b* is provided for covering a roughly upper half portion of the muffler main body 155*b*. See, FIG. 25. The heat insulating portion 197*b* is provided with a plurality of beads 211 along the vehicle width direction, so as to enhance the rigidity and to enlarge the surface area, thereby enhancing the heat releasing performance.

A bracket plate 212 is mounted to a rear portion of the heat insulating portion 197*b* over the vehicle width direction, and the bracket plate 212 is provided with a total of three mount holes 213, one in a central portion and two respectively on both sides, at positions higher than the mount surface of the bracket plate 212. A weld nut 214 is attached to the back side of each of the mount holes 213 . . . , the central mount hole 213 is attached to the rear fender upper 201 by a bolt 215 and the muffler rear cover 187 which will be described later is attached to the two mount holes 213, 213.

In addition, as shown in FIG. 24, through-holes 217 are formed on lateral sides of the arrangement position of the bracket plate 212 at positions corresponding to a mount hole 216 in the muffler rear cover 187 which will be described later. Side portions of a central portion in the front-rear direction of the bracket plate 212 are provided with mount holes 218 for fixing by fastening the bolts 198 to the mount holes 199 in the seat rail 30 through the collars 219 and the grommets 220 shown in FIG. 26.

The resin-made muffler rear cover 187 is mounted for covering an upper surface 155*u* and both side surfaces 155*s* of a rear end portion of the second exhaust muffler 155 in a manner so as to envelop the muffler protector 197.

As shown in FIGS. 26 to 29, the muffler rear cover 187 is a cup-shaped member with a lower portion opened, a rear portion provided with an opening portion 187*a* and a rear portion made a little slender. The muffler rear cover 187 is provided at the upper edge of a front portion thereof with mount holes 187*b* corresponding to the weld nuts 214 of the bracket plate 212 of the muffler protector 197. The rear cover 187 is provided in a front side wall thereof with a mount hole 216 corresponding to the through-hole 217 in the muffler protector 197. A bolt 221 passing through the mount hole 216 is fastened and fixed to a side wall of the muffler main body 155*b* of the second exhaust muffler 155. Here, the opening portion 187*a* is for opening, instead of closing, the opening portion 189 of the tail pipe 188 of the second exhaust muffler 155 which has been described above.

According to the above embodiment, the rear end portion of the second exhaust muffler 155 is covered with the resin-made muffler rear cover 187, whereby the muffler main body 155*b* extends rearwardly, and the volume of the muffler main body 155*b* is increased. This makes it possible to maintain the continuity of the appearance of the vehicle body with the muffler rear cover 187 and the rear cowl 184 while permitting the noise reducing effect of the exhaust system to be displayed sufficiently.

Therefore, it is possible to enhance the appearance quality, and to secure the degree of freedom in designing, as compared with the case where the rear end portion of the muffler main body 155*b* is directly visible.

In addition, since the heat coming from the second exhaust muffler 155 is insulated by the metallic muffler protector 197, the heat can be prevented from being radiated directly to the upper portion side of the rear fender upper 201 and the muffler rear cover 187. Therefore, it is unnecessary to use heat-resistant special materials for the muffle rear cover 187 and the rear fender upper 201 or to adopt a complicated mode of mounting with a measure against heat. Further, it is possible to achieve a reduction in cost.

Particularly, since the muffler protector 197 covers the lower surface 201*u* of the rear fender upper 201 at a position spaced from the rear fender upper 201 by a predetermined interval, the heat coming from the muffler main body 155*b* is cooled by air flowing between the muffler main body 155*b* and the muffler protector 197. In addition, at the rear end portion of the muffler main body 155*b*, the heat from the muffler main body 155*b* is cooled by air flowing through the space portions between the upper surface 155*u* and both side surfaces 155*s* of the muffler main body 155*b* and the muffler protector 197 and along the lower surface of the muffler main body 155*b* which is opened. Therefore, the cooling performance for cooling the second exhaust muffler 155, principally, the muffler main body 155*b*, can be enhanced.

Since two rear opening portions of the second exhaust muffler 155, i.e., two tail pipes 188 are disposed in the vehicle width direction, it is possible to secure the exhaust gas flow passage route in the vehicle width direction and to shorten the front-rear length of the second exhaust muffler 155, i.e., the muffler main body 155*b*. In addition, it is possible to secure the areas of the upper and lower surfaces to be large and to perform effective cooling through the upper and lower surfaces. Therefore, it is possible to suppress the rearward projection of the muffler main body 155*b* and to enhance the appearance quality.

In addition, since the muffler protector 197 is mounted to the seat rail 30 and the second exhaust muffler 155 is also mounted to the seat rail 30, there is extremely little offset in size between both the components mounted on the basis of the seat rail 30. Therefore, the muffler rear cover 187 mounted to the muffler protector 197 can be mounted without any positional offset in relation to the second exhaust muffler 155. As a result, the appearance quality can be enhanced.

In addition, since the heat of the second exhaust muffler 155 is transmitted to the muffler rear cover 187 via the muffler protector 197, the long heat transmission route reduces the quantity of heat transmitted to the muffler rear cover 187 and the muffler rear cover 187 can be prevented from being exposed to high heat.

The present invention is not limited to the above-described embodiment. For example, while the present invention has been described by taking a motorcycle as an example, the invention is applicable to four-wheel and three-wheel vehicles. Further, the number of the rear opening portions of the muffler is not limited to two but may be three or four.

The present invention can be utilized as a technology for improving an exhaust system in a motorcycle, for example.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust device comprising:

a muffler at a rear portion of an exhaust system extending rearwardly from an engine, said muffler being disposed in a rear portion of a rear cowl provided with a muffler protector, wherein a rear end surface of said muffler is covered with a resin-made muffler rear cover that is mounted on the muffler protector, the muffler rear cover is cup-shaped with a downward facing opened portion, and a rear portion provided with an opening portion, the rear portion having a reduced diameter.

2. The exhaust device according to claim 1, wherein a plurality of rear portion opening portions of said muffler are arranged in the vehicle width direction.

3. The exhaust device according to claim 1, wherein said protector includes mounting holes for receiving an attaching member for securing said muffler protector to said muffler.

4. The exhaust device according to claim 3, wherein said attaching member is a bolt for securing the muffler protector through a collar and a grommet to a frame member of a vehicle.

5. The exhaust device according to claim 1, wherein the muffler rear cover is mounted on the muffler protector for covering an upper surface and both side surfaces of a rear end portion of the muffler so as to envelop the muffler.

6. The exhaust device according to claim 1, wherein the muffler rear cover is provided with mounting holes corresponding to mounting holes in said muffler protector for securing said muffler rear cover to said muffler protector.

7. An exhaust device comprising:

a muffler at a rear portion of an exhaust system extending rearwardly from an engine, said muffler being disposed in a rear portion of a rear cowl;

wherein said rear cowl is provided with a muffler protector, and a muffler rear cover for covering a rear portion of said muffler is mounted to said muffler protector, wherein the muffler rear cover is formed with a single rear opening, the single rear opening having side edges that taper inward so that a lower portion of the opening is narrower than an upper edge of the opening.

8. The exhaust device according to claim 7, wherein a plurality of rear portion opening portions of said muffler are arranged in the vehicle width direction.

9. The exhaust device according to claim 7, wherein said muffler protector includes mounting holes for receiving an attaching member for securing said muffler protector to said muffler.

10. The exhaust device according to claim 9, wherein aid attaching member is a bolt for securing the muffler protector through a collar and a grommet to a frame member of a vehicle.

11. The exhaust device according to claim 7, wherein the muffler protector includes an extended portion for covering a piping portion of the muffler and a heat insulating portion for covering an upper half portion of the muffler.

12. The exhaust device according to claim 11, wherein said heat insulating portion is provided with a plurality of beads disposed in a width direction of the muffler for enhancing the rigidity and enlarging the surface area thereof.

13. The exhaust device according to claim 11, and further including a bracket plate mounted on a rear portion of the heat insulating portion for mounting the muffler protector and the muffler rear cover relative to each other.

14. An exhaust device comprising:

a muffler at a rear portion of an exhaust system extending rearwardly from an engine, said muffler being disposed in a rear portion of a rear cowl, wherein a metallic muffler protector is provided for covering a lower surface of a rear fender at a position spaced from said rear fender by a predetermined interval, and a muffler rear cover for covering an upper surface and both side surfaces of said muffler is mounted to said muffler protector, wherein the muffler rear cover includes a downward facing opened portion so that the muffler rear cover does not cover a lower surface of the muffler.

15. The exhaust device as set forth in claim 14, wherein a plurality of rear portion opening portions of said muffler are arranged in the vehicle width direction.

16. The exhaust device according to claim 14, wherein said muffler protector includes mounting holes for receiving an attaching member for securing said muffler protector to said muffler.

17. The exhaust device according to claim 16, wherein said attaching member is a bolt for securing the muffler protector through a collar and a grommet to a frame member of a vehicle.

18. The exhaust device according to claim 14, wherein the muffler protector includes an extended portion for covering a piping portion of the muffler and a heat insulating portion for covering an upper half portion of the muffler.

19. The exhaust device according to claim 18, wherein said heat insulating portion is provided with a plurality of beads disposed in a width direction of the muffler for enhancing the rigidity and enlarging the surface thereof.

20. An exhaust device of a motorcycle comprising:

a muffler extending rearwards from an engine and being provided at the rear portion of a rear cowl, wherein said muffler is provided with a bracket extending upwards from the muffler and connecting the muffler with a seat rail, wherein the upper surface of said muffler is covered by a metal muffler protector and there is a spaced portion between said muffler and said metal muffler protector, said metal muffler protector covering a lower surface of a rear fender at a position spaced from said rear fender by a predetermined interval, wherein the muffler includes a piping portion and a muffler main body, and wherein the muffler protector extends along a length of the piping portion and the muffler main body.

21. The exhaust device according to claim 20, wherein said bracket is connecting the muffler to the inner side of the seat rail.

22. The exhaust device according to claim 20, wherein the rear end surface of said muffler is covered with a cup-shaped resin muffler rear cover.

23. An exhaust device according to claim 20, wherein a pair of brackets is for connecting the muffler to the seat rail, wherein said pair of brackets is attached to the muffler such that the brackets are spaced from each other in the width direction of a vehicle.

24. An exhaust device of a motorcycle comprising:

a muffler at a rear portion of an exhaust system extending rearwardly from an engine, said muffler being disposed in a rear portion of a rear cowl and on a center line of a longitudinal direction of the motorcycle;

wherein, except for a rear end of the muffler, an upper surface of said muffler is covered by a rear fender upper, wherein a rear end surface of said muffler is covered with a resin-made muffler rear cover, the muffler rear cover being cup-shaped with a downward facing opened portion, and a rear portion provided with an opening portion, the rear portion having a reduced diameter, and wherein a rear fender is disposed beneath the muffler rear cover for covering a rear wheel.

25. The exhaust device according to claim 24, wherein said attaching member is a bolt for securing the muffler rear cover through a collar and a grommet to a muffler protector.

26. The exhaust device according to claim 20, wherein the muffler is provided with a flat shape in the vehicle width direction, and wherein an exhaust pipe is connected to one side of a front end of the muffler in a vehicle width direction.

27. The exhaust device according to claim 24, further comprising a muffler protector provided for covering both sides of said muffler.

28. The exhaust device according to claim 24, further comprising an exhaust pipe disposed inside a step of the motorcycle.

* * * * *